US009960469B1

(12) United States Patent
Aster

(10) Patent No.: US 9,960,469 B1
(45) Date of Patent: May 1, 2018

(54) BROADBAND REACTIVE POWER COMBINERS AND DIVIDERS INCLUDING NESTED COAXIAL CONDUCTORS

(71) Applicant: David B. Aster, Spokane Valley, WA (US)

(72) Inventor: David B. Aster, Spokane Valley, WA (US)

( * ) Notice: Subject to any disclaimer, the term of this patent is extended or adjusted under 35 U.S.C. 154(b) by 0 days. days.

(21) Appl. No.: 15/614,572

(22) Filed: Jun. 5, 2017

Related U.S. Application Data

(63) Continuation-in-part of application No. 15/043,570, filed on Feb. 14, 2016, now Pat. No. 9,673,503, and a continuation-in-part of application No. 15/078,086, filed on Mar. 23, 2016, now Pat. No. 9,793,591.

(60) Provisional application No. 62/140,390, filed on Mar. 30, 2015.

(51) Int. Cl.

| | |
|---|---|
| ***H01P 5/12*** | (2006.01) |
| ***H01P 1/213*** | (2006.01) |
| ***H01P 11/00*** | (2006.01) |
| ***H01P 1/202*** | (2006.01) |

(52) U.S. Cl.
CPC ..... *H01P 1/213* (2013.01); *H01P 1/202* (2013.01); *H01P 5/12* (2013.01); *H01P 11/001* (2013.01); *H01P 11/007* (2013.01)

(58) Field of Classification Search
CPC .. H01P 5/12; H01P 1/213; H01P 1/202; H01P 11/01; H01P 11/007
USPC ..... 333/137
See application file for complete search history.

(56) References Cited

U.S. PATENT DOCUMENTS

| | | | |
|---|---|---|---|
| 2,946,965 | A | 7/1960 | Albanese |
| 3,931,587 | A | 1/1976 | Harp et al. |
| 4,032,865 | A | 6/1977 | Harp et al. |
| 4,035,746 | A | 7/1977 | Covington, Jr. |
| 4,152,680 | A | 5/1979 | Harrison |
| 4,188,590 | A | 2/1980 | Harp et al. |
| 4,238,747 | A | 12/1980 | Harp et al. |
| 4,266,208 | A | 5/1981 | Cornish |
| 4,453,139 | A | 6/1984 | Labaar |

(Continued)

OTHER PUBLICATIONS

Aug. 25, 2017 office action in U.S. Appl. No. 15/582,533.

(Continued)

*Primary Examiner* — Robert J Pascal
*Assistant Examiner* — Kimberly Glenn
(74) *Attorney, Agent, or Firm* — Deepak Malhotra; Malhotra Law Firm, PLLC

(57) ABSTRACT

A power combiner/divider having a front end and a rear end and including a stepped main center conductor defining an axis and having portions with different outer diameters; an input connector having a center conductor, adapted to be coupled to a signal source, electrically coupled to the main conductor and having an axis aligned with the main conductor axis; a plurality of output connectors having respective axes that are perpendicular to the main conductor axis, the output connectors being radially spaced apart relative to the main conductor, the output connectors having center conductors; a plurality of nested cylinders proximate the front end and arranged with gaps defining at least three gaps providing coaxial transmission lines; and a plurality of nested cylinders proximate the rear end, one of which having apertures perpendicular to the main conductor axis receiving the center conductors of the output connectors, the nested cylinders proximate the rear end defining at least three gaps.

20 Claims, 25 Drawing Sheets

(56) References Cited

U.S. PATENT DOCUMENTS

| | | | |
|---|---|---|---|
| 4,598,254 | A | 7/1986 | Saito et al. |
| 4,694,260 | A | 9/1987 | Argintaru et al. |
| 4,700,145 | A | 10/1987 | Yelland |
| 4,835,496 | A | 5/1989 | Schellenberg et al. |
| 5,142,253 | A | 8/1992 | Mallavarpu et al. |
| 5,389,890 | A | 2/1995 | Burrage |
| 5,644,272 | A | 7/1997 | Dabrowski |
| 5,777,527 | A | 7/1998 | Sanders |
| 5,784,033 | A | 7/1998 | Boldissar, Jr. |
| 5,847,625 | A | 12/1998 | Gillette |
| 6,005,450 | A | 12/1999 | Schmidt et al. |
| 6,018,277 | A | 1/2000 | Vaisanen |
| 6,919,776 | B1 | 7/2005 | Mobius et al. |
| 7,102,459 | B1 | 9/2006 | Arnold et al. |
| 7,215,218 | B2 | 5/2007 | Bums et al. |
| 7,397,328 | B2 | 7/2008 | Yasuda et al. |
| 7,468,640 | B2 | 12/2008 | Nosaka |
| 7,479,850 | B2 | 1/2009 | Kearns et al. |
| 8,120,444 | B2 | 2/2012 | Haunberger et al. |
| 8,508,313 | B1 | 8/2013 | Aster |
| 9,065,163 | B1 | 6/2015 | Wu |
| 9,673,503 | B1 | 6/2017 | Aster |
| 2013/0335162 | A1 | 12/2013 | Sun |

OTHER PUBLICATIONS

Kenneth J. Russell, 'Microwave power combining techniques,' IEEE Transactions on Microwave Theory and Techniques, May 1979, pp. 472-478.

Clayton R. Paul, Analysis of Multiconductor Transmission Lines, John Wiley & Sons, New York, New York, 1994, pp. 219-222.

G. C. Temes and S. K. Mitra, Modern Filter Theory and Design, John Wiley & Sons, New York, New York, 1973, pp. 276-284.

G. Matthaei, L. Young, E.M.T. Jones, Microwave Filters, Impedance-matching Networks, and Coupling Structures, Artech House Books, Dedham, MA, pp. 585-595.

G. C. Temes and S. K. Mitra, Modern Filter Theory and Design, John Wiley & Sons, New York, New York, pp. 306-308, 1973.

G. Matthaei, L. Young, E.M.T. Jones, Microwave Filters, Impedance-matching Networks, and Coupling Structures, Artech House Books, Dedham, MA, pp. 595-599.

"Choosing the Best Power Divider for the Task of Signal Combining" retrieved from: http://www.microlab.fxr.com/resource-library?brand=Microlab&go=application_notes, downloaded and printed on Feb. 6, 2016 (6 pages).

"Reactive vs. Wilkinson Splitters" retrieved from: http://www.microlab.fxr.com/resource-library?brand=Microlab&go=application_notes, downloaded and printed on Feb. 6, 2016 (2 pages).

"Dividers & Combiners" retrieved from: http://www.microlab.fxr.com/resource-library?brand=Microlab&go=application_notes, downloaded and printed on Feb. 6, 2016 (4 pages).

G. Matthaei, L. Young, E.M.T. Jones, Microwave Filters, Impedance-matching Networks, and Coupling Structures, Artech House Books, Dedham, MA, p. 220.

Wilkinson, Ernest J., An N-Way Hybrid Power Divider, Jan. 1960, pp. 116-118, IRE Transactions on Microwave Theory and Techniques.

Horton, M.C., and Wenzel, R.J., General Theory and Design of Optimum Quarter-Wave TEM Filters, May 1965, pp. 316-327, IEEE Transactions on Microwave Theory and Techniques.

First Office Action, dated Jul. 5, 2016, in U.S. Appl. No. 15/043,570, invented by the inventor hereof.

Second Office Action, dated Nov. 17, 2016, in U.S. Appl. No. 15/043,570, invented by the inventor hereof.

Electronics Research, Inc., Installation Instructions II2302, EIA Flange Adapters for Rigid Transmission Lines.

Matthaei, Young, and Jones, Microwave Filters, Impedance-Matching Networks, and Coupling Structures, 1980, p. 302, Artech House Books.

Patzelt and Arndt, Double-Plane Steps in Rectangular Waveguides and their Application for Transformers, Irises, and Filters, pp. 772-776, May 5, 1982, IEEE Transactions on Microwave Theory and Techniques.

Whinnery, Jamieson, and Robbins, Coaxial-Line Discontinuities, p. 695, Nov. 1944, Proceedings of the I.R.E.

Semi-Flexible Air Dielectric Coaxial Cables and Connectors, 50 Ohms, EIA Standard RS-258, Mar. 1962, Table 1 and pp. 5-6.

Jul. 20, 2017 office action in U.S. Appl. No. 15/078,086.

Jul. 14, 2017 office action in U.S. Appl. No. 15/493,074.

Jul. 11, 2017 office action in U.S. Appl. No. 15/493,591.

Unpublished U.S. Appl. No. 15/078,086, filed Mar. 23, 2016.

Unpublished U.S. Appl. No. 15/493,074, filed Apr. 20, 2017.

Unpublished U.S. Appl. No. 15/493,591, filed Apr. 21, 2017.

Unpublished U.S. Appl. No. 15/582,533, filed Apr. 28, 2017.

Section 3 - 3

Section 11 - 11

Section 12 - 12

Section 13 - 13

200 →

300 →

$Z_S = Z_L = 50$ ohms
$Z_1 = 43.0$ ohms
$Z_2 = 32.3$ ohms
$Z_3 = 20.8$ ohms
$Z_4 = 11.9$ ohms
$Z_5 = 6.5$ ohms
$Z_6 = 6.5$ ohms
$Z_{SH} = 12.7$ ohms
$Z_L/N = 5.0$ ohms
$\theta_5 + \theta_6 = \theta$ $$\begin{bmatrix} \bar{B} \\ \bar{D} \end{bmatrix} = \mathbf{M} \begin{bmatrix} \bar{A} \\ \bar{C} \end{bmatrix};$$

$$\rho_1 = |\rho| e^{j\Phi_1} = D_0 / C_0$$

$$\rho_2 = |\rho| e^{j\Phi_2} = B_0 / A_0$$

BROADBAND REACTIVE POWER COMBINERS AND DIVIDERS INCLUDING NESTED COAXIAL CONDUCTORS

CROSS REFERENCE TO RELATED APPLICATION

This is a continuation-in-part of U.S. patent application Ser. No. 15/043,570, filed Feb. 14, 2016, and a continuation-in-part of U.S. patent application Ser. No. 15/078,086, filed Mar. 23, 2016, both of which in turn claim priority to U.S. Provisional Patent Application Ser. No. 62/140,390, filed Mar. 30, 2015, all of which were invented by the inventor hereof and all of which are incorporated herein by reference.

TECHNICAL FIELD

The technical field includes methods and apparatus for summing (or combining) the signals from a microwave antenna array or for combining a number of isolator-protected power sources or for dividing power into a number of separate divided output signals.

BACKGROUND

The communications and radar industries have interest in reactive-type broadband microwave dividers and combiners. Even though not all ports are RF matched, as compared to the Wilkinson power divider/combiner (see Ernest J. Wilkinson, "An N-way hybrid power divider," IRE Trans. on Microwave Theory and Techniques, January, 1960, pp. 116-118), the reactive-type mechanical and electrical ruggedness is an advantage for high-power combiner applications. This assumes that the sources to be combined are isolator-protected and of equal frequency, amplitude and phase. Another combiner application is improving the signal-to-noise ratio of faint microwave communication signals using an antenna dish array connected to the reactive power combiner using phase length-matched cables. The signal from each dish antenna sees an excellent "hot RF match" into each of the N combining ports of the reactive power combiner and is therefore efficiently power combined with the other N−1 antenna signals having equal frequency, amplitude, and phase. However, the cable- and antenna-generated thermal noise signal into each port of the N-way power combiner (with uncorrelated phase, frequency and amplitude) sees an effective "cold RF match" and is thus poorly power combined. The signal-to-noise ratio improves for large values of the number of combiner ports N. Still another application is for one of two reactive N-way power dividers to provide a quantity N signals of equal phase, amplitude and frequency as inputs to a set of N broadband amplifiers each with a noise figure X db/MHz. A second high-power N-way reactive power combiner is used to combine the N amplified signals with the benefit of improving the overall total noise figure by several dB.

An example of a reactive combiner/divider is described in U.S. Pat. No. 8,508,313 to Aster, incorporated herein by reference. Broadband operation is achieved using two or more stages of multiconductor transmission line (MTL) power divider modules. An 8-way reactive power divider/combiner 200 of this type is shown in FIGS. 4 and 5 of application Ser. No. 15/043,570. Described as a power divider, microwave input power enters coax port 201, which feeds a two-way MTL divider 202. Input power on the main center conductor 206 (FIG. 6a, Section a1-a1) is equally divided onto two satellite conductors 207 which in turn each feed quarter-wave transmission lines housed in module 203 (FIG. 4). Each of these quarter-wave lines feeds a center conductor 208 (FIG. 6b, Section a2-a2) in its respective four-way MTL divider module 204, power being equally divided onto satellite conductors 209 which in turn feed output coax connectors 205. This may also be described as a two-stage MTL power divider where the first stage two-way divider (Stage B, FIG. 7) feeds a second stage (Stage A, FIG. 7) consisting of two 4-way MTL power dividers, for a total of eight outputs 205 of equally divided power. This two-stage divider network is described electrically in FIG. 7 as a shorted shunt stub ladder filter circuit with a source admittance $Y_S^{(B)}$ and a load admittance $N_S^{(B)}N_S^{(A)}Y_L^{(A)}$. The first-stage (Stage B) quarter-wave shorted shunt stub transmission line characteristic admittances have values $Y_{10}^{(B)}$ and $N_S^{(B)}Y_{20}^{(B)}$, respectively, which are separated by a quarter-wave main line with characteristic admittance value $N_S^{(B)}Y_{12}^{(B)}$. Here the number of satellite conductors $N_s^{(B)}=2$, $N_S^{(A)}=4$ and $Y_{12}^{(B)}$ is the value of the row 1, column 2 element of the 3×3 characteristic admittance matrix $Y^{(B)}$ for the two-way MTL divider (Section a1-a1, FIG. 6). Also, $Y_{10}^{(B)}=Y_{11}^{(B)}+N_S^{(B)}Y_{12}^{(B)}$ and $Y_{20}^{(B)}=Y_{22}^{(B)}+Y_{12}^{(B)}+Y_{23}^{(B)}$. Each quarter-wave transmission line within housing 203 (FIG. 4) has characteristic admittance $Y_T$ and is represented in the equivalent circuit FIG. 7 as a quarter-wave main transmission line with characteristic admittance $N_S^{(B)}Y_T$. The second stage (Stage A) quarter-wave shorted shunt stub transmission line characteristic admittances have values $N_S^{(B)}Y_{10}^{(A)}$ and $N_S^{(B)}N_S^{(A)}Y_{20}^{(A)}$, respectively, which are separated by a quarter-wave main line with characteristic admittance $N_S^{(B)}N_S^{(A)}Y_{12}^{(A)}$. Here $Y_{12}^{(A)}$ is the value of the row 1, column 2 element of the 5×5 characteristic admittance matrix $Y^{(A)}$ for one of the two identical four-way MTL divider modules 204 (FIG. 4) with cross-section a2-a2 in FIG. 6b. A plot of scattering parameters for an octave bandwidth two-stage eight-way divider is shown in FIG. 4c of U.S. Pat. No. 8,508,313. Due to its complexity, the two-stage, three MTL module power divider/combiner as shown in FIGS. 4 and 5 is expensive to fabricate.

SUMMARY

Some embodiments provide a power divider/combiner having an input, a plurality of outputs, and nested unit element conductors, having a bandwidth of about 0.65 to 2.95 GHz, and having a shorter length than non-nested power divider/combiners. Some embodiments provide a reactive 10-way divider/combiner.

Some embodiments provide a reactive 10-way divider/combiner.

Some embodiments provide a power combiner/divider having a front end and a rear end and including a main center conductor defining a central axis and being stepped, having first and second portions with different outer diameters; an input connector having a center conductor, adapted to be coupled to a signal source, electrically coupled to the main conductor and having an axis aligned with the central axis; a plurality of output connectors having respective axes that are perpendicular to the main conductor axis, the output connectors being radially spaced apart relative to the main conductor, the output connectors having center conductors; a plurality of electrically conductive nested cylinders proximate the front end and arranged to define at least three gaps providing respective coaxial transmission lines; and a plurality of electrically conductive nested cylinders proximate the rear end, one of which having apertures perpendicular to the main conductor axis receiving the center conductors of the output connectors, the nested cylinders proximate the rear end defining at least three gaps.

Other embodiments provide a power combiner/divider having a front end and a rear end and including a main center conductor defining a central axis and being stepped, having first, second, and third portions with different outer diameters; an input connector having a center conductor, adapted to be coupled to a signal source, electrically coupled to the main conductor and having an axis aligned with the central axis; a plurality of output connectors having respective axes that are perpendicular to the main conductor axis, the output connectors being radially spaced apart relative to the main conductor, the output connectors having center conductors; a plurality of electrically conductive nested cylinders proximate the front end and arranged to define at least three gaps providing respective coaxial transmission lines; and a plurality of electrically conductive nested cylinders proximate the rear end, one of which being electrically coupled to the center conductors of the output connectors, the nested cylinders proximate the rear end defining a nested unit element coaxial transmission line and a unit element shorted shunt stub.

Still other embodiments provide a method of manufacturing a power combiner/divider, having a front end and a rear end, the method including providing a main center conductor defining a central axis and being stepped, having first, second, and third portions with different outer diameters; providing an input connector having a center conductor, adapted to be coupled to a signal source and having an axis aligned with the central axis; electrically coupling the input connector to the main conductor; providing a plurality of output connectors having respective axes that are perpendicular to the main conductor axis, the output connectors being radially spaced apart relative to the main conductor, the output connectors having center conductors; providing a plurality of electrically conductive nested cylinders proximate the front end; arranging the nested cylinders to include three coaxial transmission lines; providing a plurality of electrically conductive nested cylinders proximate the rear end; electrically coupling one of the nested cylinders proximate the rear end to the center conductors of the output connectors; and defining a nested unit element coaxial transmission lines and a unit element shorted shunt stub using the conductive nested cylinders proximate the rear end.

DETAILED DESCRIPTION OF THE ILLUSTRATED EMBODIMENTS

Attention is directed to U.S. patent application Ser. No. 15/493,074, filed Apr. 20, 2017, U.S. patent application Ser. No. 15/493,591, filed Apr. 21, 2017, and U.S. patent application Ser. No. 15/582,533, filed Apr. 28, 2017, all of which were invented by the inventor hereof and all of which are incorporated herein by reference.

Figure 1:
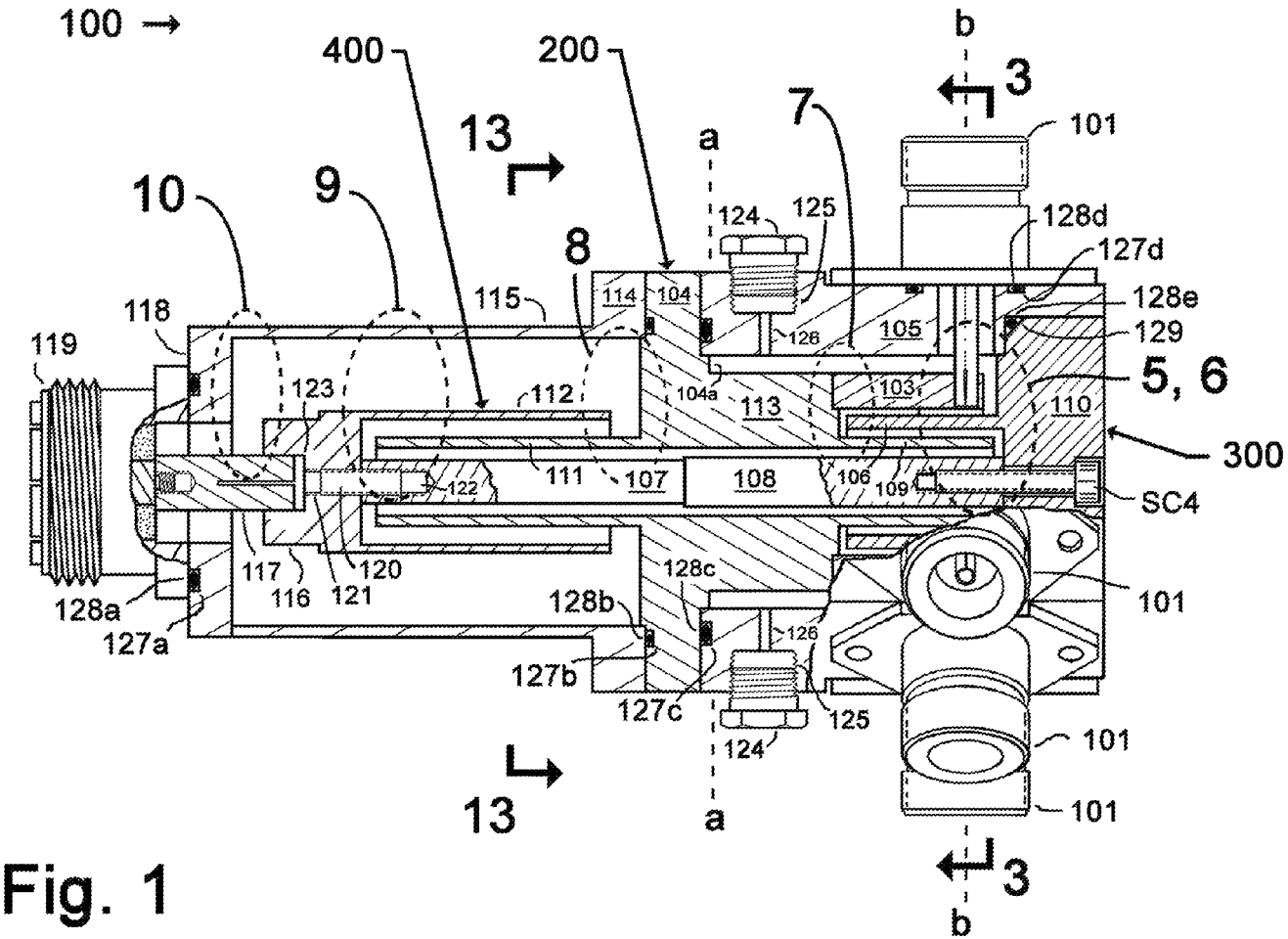
FIG. 1 is a side view of a power divider/combiner in accordance with various embodiments, partly in section.

FIG. 1 shows a microwave power divider 100, which can alternatively be used as a power combiner, in accordance with various embodiments. It will hereinafter be referred to as a power divider-combiner 100.

Hereinafter described as if for use as a power divider, the power divider-combiner 100 has (see FIGS. 1 and 22) a single main input port flange 118 defining a front end, a central axis, and a quantity N of output port connectors 101 proximate a rear end. It is to be understood that, for convenience, the terms "input" and "output", when used herein and in the claims, assume that the divider-combiner is being used as a power divider. The roles of the inputs and outputs are reversed when the divider-combiner is being used as a power combiner.

Figure 2:
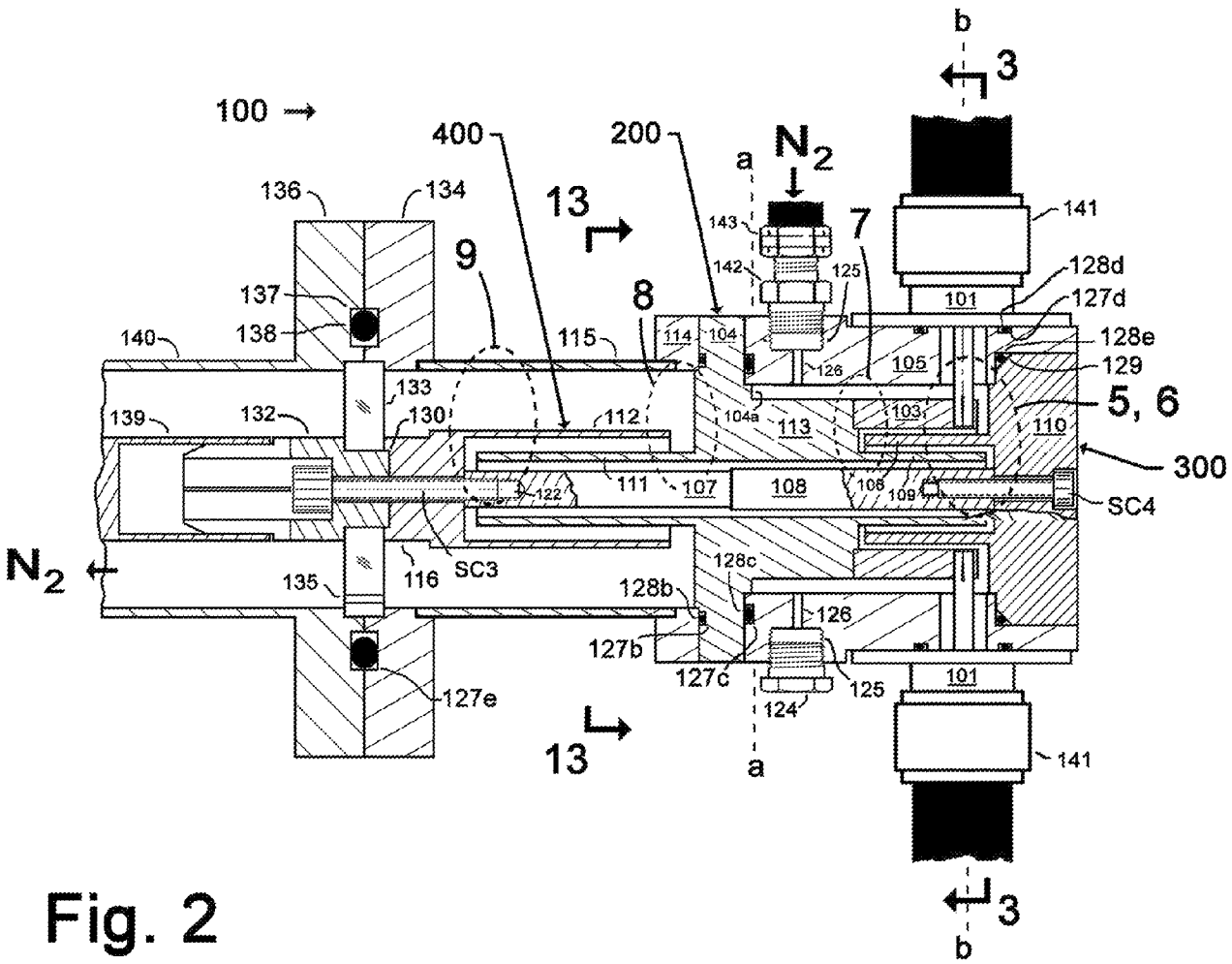
FIG. 2 is a power divider/combiner in accordance with alternative embodiments, also showing coaxial cables attached and with one plug replaced with a pressure valve to allow the introduction of a gas.
Figure 20:
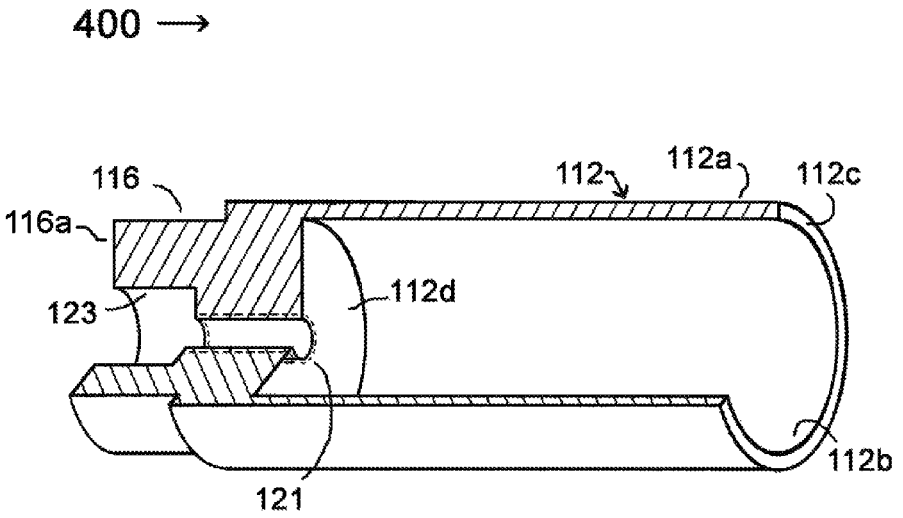
FIG. 20 is a perspective view of a conductor included in the divider/combiner of FIG. 1, partly in section.
Figure 23:
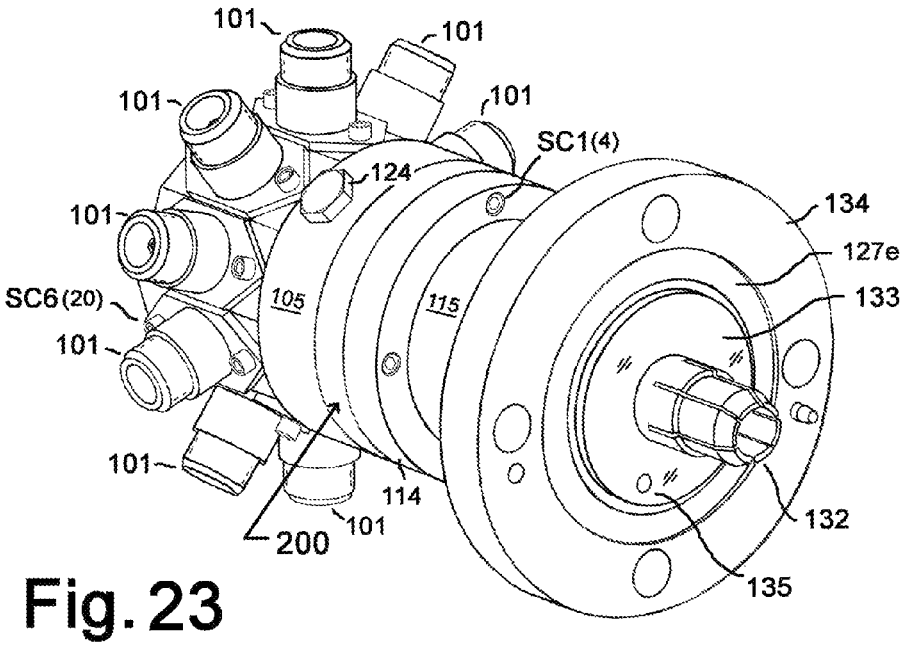
FIG. 23 is a perspective view of the divider-combiner of FIG. 2.

In the illustrated embodiments, the power divider-combiner 100 (see FIG. 1) has, at a forward end, an input RF connector 119 which is 7-16 DIN female. Other embodiments are possible. For example, in the modified form of construction shown in FIG. 2 and FIG. 23, the input RF connector is 1⅝ EIA having flange 134, dielectric disk 133, and slotted contact bullet 132 each of which dimensionally conform to Electronic Industries Association Standard RS-258. Other connector types, such as Type N male or female, ⅞ EIA, SC (male or female), LC (male or female), TNC (male or female), or SMA (male or female), for example, could be employed. In the illustrated embodiments, the divider-combiner 100 of FIG. 1 includes an input side main center conductor portion 116 having an inner cylindrical portion with a cylinder axis aligned (coincident) with the central axis of the divider-combiner 100 and that has a rear opening. The main center conductor portion 116 further has a bore 123 in a front end of the main center conductor portion 116, and a threaded bore 121 extending forwardly from the inner cylindrical portion. In the illustrated embodiments, the divider-combiner 100 includes, along its main axis a center conductor contact bullet 117 that is received in the bore 123 of the main center conductor portion 116 (FIGS. 1, 20). In the illustrated embodiments, the rearward end of the bullet 117 is slotted. The RF connector 119 has a center conductor and a forward end of the bullet 117 is either soldered or screwed onto the center conductor of RF connector 119. The power divider-combiner 100 includes a main center conductor portion 107 having a front end with a threaded bore 122. The power divider-combiner 100 includes a screw 120, such as an Allen screw, (FIGS. 1, 27) that engages the threaded bore 121 of the conductor portion 116 (FIGS. 1, 20) and also engages the threaded bore 122 of the main center conductor portion 107. In the embodiments of FIGS. 2, and 23, the power divider-combiner 100 includes a cap screw SC3 (see FIG. 28), which engages the threaded bore 121 of the main conductor portion 116, thereby securing the dielectric disk 133, and which also engages the threaded bore 122 of the main center conductor portion 107. The material for bullets 117 or 132 may be, but is not limited to, any of the following age-hardened alloys: BeCu, chrome copper, Consil, or phosphor bronze. The bullets 117 or 132 may be gold plated or silver plated with a rhodium flash for corrosion protection.

The power divider-combiner 100 has (see FIG. 1, 2, 3, 22 or 23), in the illustrated embodiments, ten Type N (female) connectors for the output ports 101. Other types of output and input RF connectors are possible.

The power divider-combiner 100 includes a cylindrical conductor 103 defining, in some embodiments, the shape of or the general shape of a hollow cylinder (see FIG. 4, 11, 18, 27 or 28) and having an inner cylindrical surface 103*b* with a cylinder axis aligned with the central axis, an outer cylindrical surface 103*a*, and a rearward facing opening. Each output RF connector 101 has a center conductor 102 electrically connected with the rearward end of the conductor 103.

Figure 5:
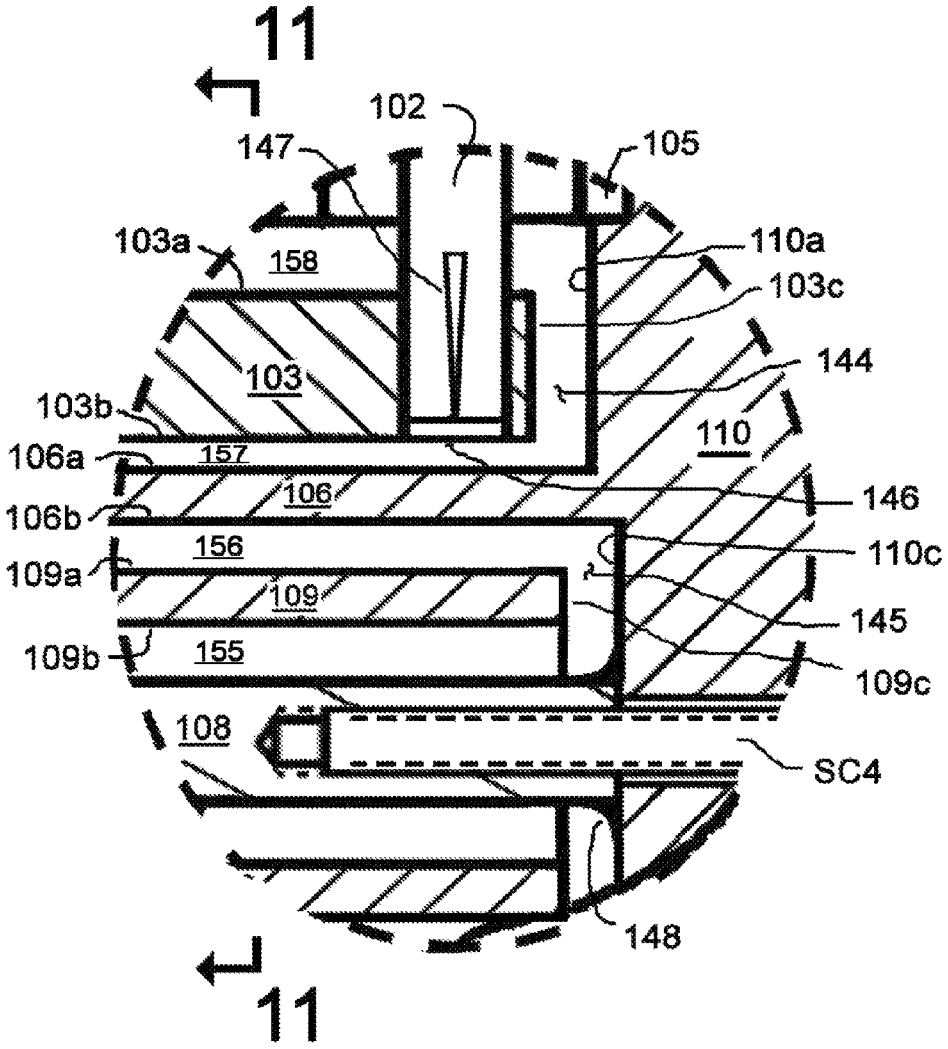
FIG. 5 is a partial cut-away view of the divider/combiner of FIG. 1 or FIG. 2 showing a connection point in the area of FIG. 1 or FIG. 2 indicated with reference numeral 5.
Figure 6:
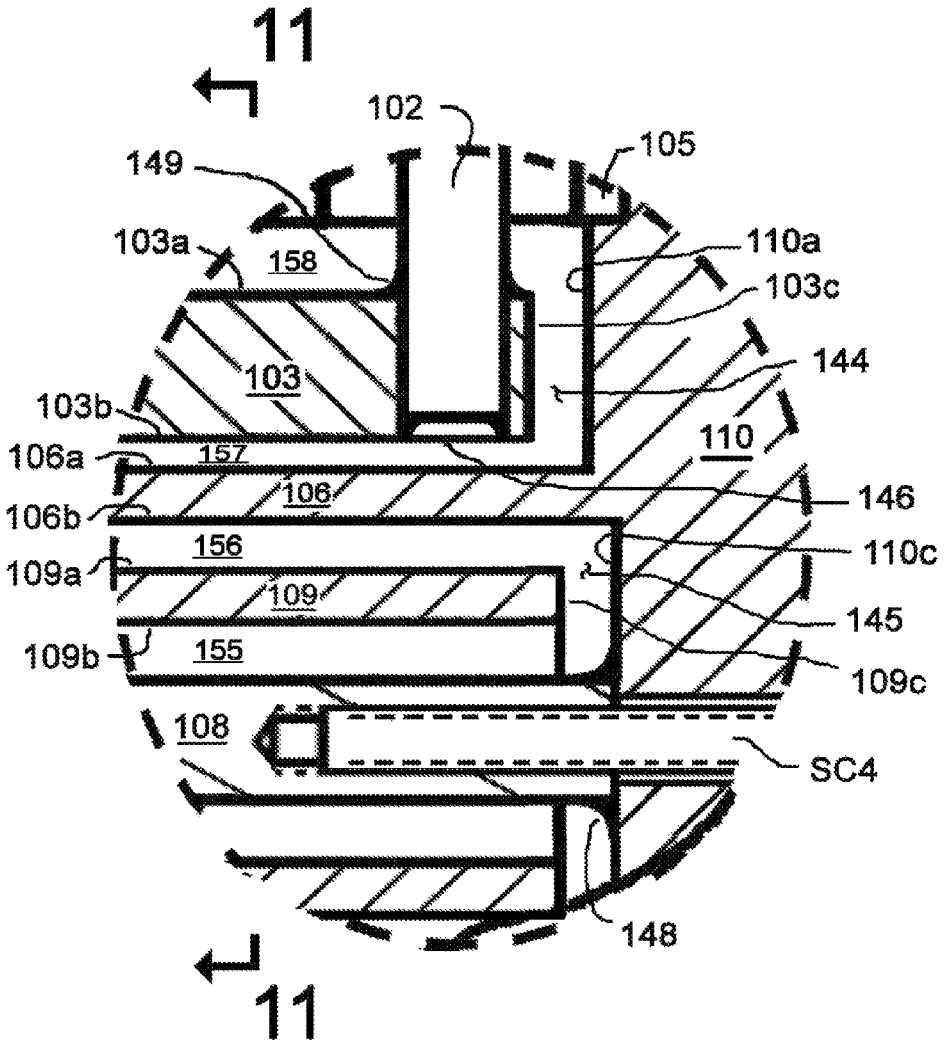
FIG. 6 is a partial cut-away view of the divider/combiner of FIG. 1 or FIG. 2 showing a connection point in the area of FIG. 1 or FIG. 2 indicated with reference numeral 6, in accordance with alternative embodiments.

The conductor 103 has a rear end 103*c*, has a front end 103*d*, and has, near the rear end 103*c*, bores 146 (FIG. 18) extending from the outer cylindrical surface 103*a* of the conductor 103 to the inner cylindrical surface 103*b*. FIG. 5 shows center conductor 102 with a slotted end 147 distal from the output port 101 (see FIG. 3) and compression fit into one of the receiving bores 146. FIG. 6 shows an alternative connection. In the embodiments of FIG. 6, the center conductor 102 is attached with solder or braze alloy 149 into the bore 146 to form the electrical and thermal connection to the conductor 103.

The power divider-combiner 100 includes a cylinder conductor 106 defining, in some embodiments, the shape of or the general shape of a hollow cylinder (see FIGS. 4, 11, 19, and 27 or 28) and having an inner cylindrical surface 106*b* with a cylinder axis aligned with the central axis, an outer cylindrical surface 106*a*, a front end 106*c*, and a forward facing opening. At least a portion of the conductor 106 is received in the conductor 103, via its rearward facing opening, with a radial gap 157 between inner surface 103*b* and outer surface 106*a* (see FIGS. 5, 6, 7 and 11).

The power divider-combiner 100 further includes a cylindrical conductor 109 defining, in some embodiments, the shape of or the general shape of a hollow cylinder (see FIGS. 4, 11, 17, and 27 or 28) and having an inner cylindrical surface 109*a*, a rear end 109*c*, and a rearward facing opening. At least a portion of the conductor 109 is received in the conductor 106, via its forward facing opening, with a radial gap 156 between inner surface 106*b* and outer surface 109*a*.

The power divider-combiner 100 further includes a cylindrical conductor 112 defining, in some embodiments, the shape of or the general shape of a hollow cylinder (see FIG. 12, 13, 20 or 21, and 27 or 28) and having an inner cylindrical surface 112*b* with a cylinder axis aligned with the central axis, an outer cylindrical surface 112*a*, a rear end 112*c*, and a rearward facing opening. The power divider-combiner 100 further includes a cylindrical conductor 111 defining, in some embodiments, the shape of or the general shape of a hollow cylinder (see FIGS. 12, 13, 17, and 27 or 28) and having an inner cylindrical surface 111*b* with a cylinder axis aligned with the central axis, an outer cylindrical surface 111*a*, a front end 111*c*, and a forward facing opening. At least a portion of the conductor 111 is received in the conductor 112, via its rearward facing opening, with a radial gap 160 (see FIGS. 9 and 12) between inner surface 112*b* and outer surface 111*a*.

Figure 21:
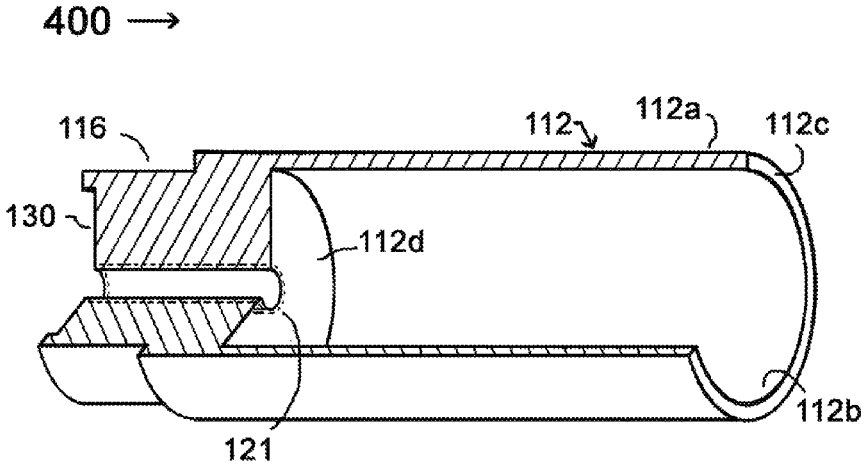
FIG. 21 is a perspective view of a conductor in alternative embodiments to those shown in FIG. 20.

The main center conductor portion 116 has a rearward end that mechanically and electrically connects to the forward end of cylinder conductor 112. In some embodiment, the main center conductor portion 116 is integral with the cylinder conductor 112 and the assembly is hereafter referred to as a stepped main conductor-cylinder 400 (see FIG. 1, 2, 20 or 21). The portions 116 and 112 are cylindrical in the illustrated embodiments; however, other shapes are possible. FIG. 1 shows the electrical contact bullet 117 received in the bore 123 in the portion 116 of stepped conductor-cylinder assembly 400, in the illustrated embodiments. FIG. 2 shows an embodiment where the rearward end of the 1⅝ EIA contact bullet 132 is received in an alignment counterbore 130 in the modified form of construction of conductor 116 (FIG. 21). FIG. 2 also shows the customer's 1⅝ EIA input cable assembly composed of cable center conductor 139, outer conductor 140, mating flange 136, and O-ring 138. Also shown in FIG. 2 are the customer's output cables 141 connected to the output RF connectors 101.

The power divider-combiner 100 further includes, aligned along the central axis, a center conductor portion 108 which has an outer diameter that is stepped relative to the outer diameter of the conductor portion 107. Both of the center conductor portions 107 and 108 are cylindrical in shape, although other cross section shapes are possible. Referring to the embodiments shown in FIGS. 1, 2, 14, 27, and 28, center conductor portions 107 and 108 are shown mechanically and electrically joined as one piece. Other embodiments are possible, for example such as a soldered, brazed, or fastened together with a screw such as an Allen screw.

The power divider-combiner 100 further includes, at a rearward end, an electrically and thermally conducting outer backplate or rear flange 110 having a forward facing surface 110*c*. The rearward end of main conductor portion 108 electrically and thermally connects to the forward facing surface 110*c* of backplate 110 (FIG. 1 or 2, 5 or 6, and 19), to which the rearward end of conducting cylinder 106 also connects. In the embodiments shown in FIGS. 1, 2, 5, 6, 14 and 19 the cylinder conductor 106 and the rear flange 110 are shown as one piece, hereafter referred to as cylinder-flange 300 (see FIG. 19). Other embodiments are possible, such as a soldered or brazed connection. The rear flange 110 includes an alignment hub outer surface 110*b* and radial transmission line conducting surfaces 110*a* and 110*c*.

The power divider-combiner 100 further includes (see FIG. 17) an inner flange 104 that is electrically and thermally conducting, and has an alignment hub 104*c*, in the illustrated embodiments. The power divider-combiner 100 further includes a cylindrical conductor 113 defining, in some embodiments, the shape of or the general shape of a hollow cylinder (see FIG. 17) and having an outer cylindrical surface 113*a*, an alignment hub 113*b*, a thermal and electrical contact face 113*d*, and a conducting radial line surface 113*c*. The conductor 113 has a forward end that is electrically and thermally connected to the rearward face of inner flange 104. The cylindrical conductor 111 has a rearward end that is electrically and thermally connected to the forward face of inner flange 104. The cylinder conductor 109 has a forward end that is electrically and mechanically connected to the rearward face of cylinder conductor 113. In the embodiments shown in FIGS. 1, 2, 14 and 17 the cylinder conductors 109, 111, 113 and the inner flange 104 are shown as one piece, hereafter referred to as cylinder-flange 200 (see FIG. 17). In the embodiments shown in FIGS. 1, 2, 7, and 14 the forward end of conducting cylinder 103 is shown as soldered or brazed to connect electrically and mechanically to the rearward face 113*d* of cylinder-flange 200. Other embodiments are possible: the conducting cylinder 103 and the cylinder-flange 200 may be fabricated as one piece.

In the illustrated embodiments (FIGS. 5, 6, and 7), there is a radial gap 155 between the outer surface of the main conductor portion 108 and: 1) the inner surface 109*b*, 2) the inner surface of 113. There is also a radial gap 159 (see FIGS. 8 and 12) between the outer surface of the main conductor portion 107 and the inner surface 111*b*.

Figure 7:
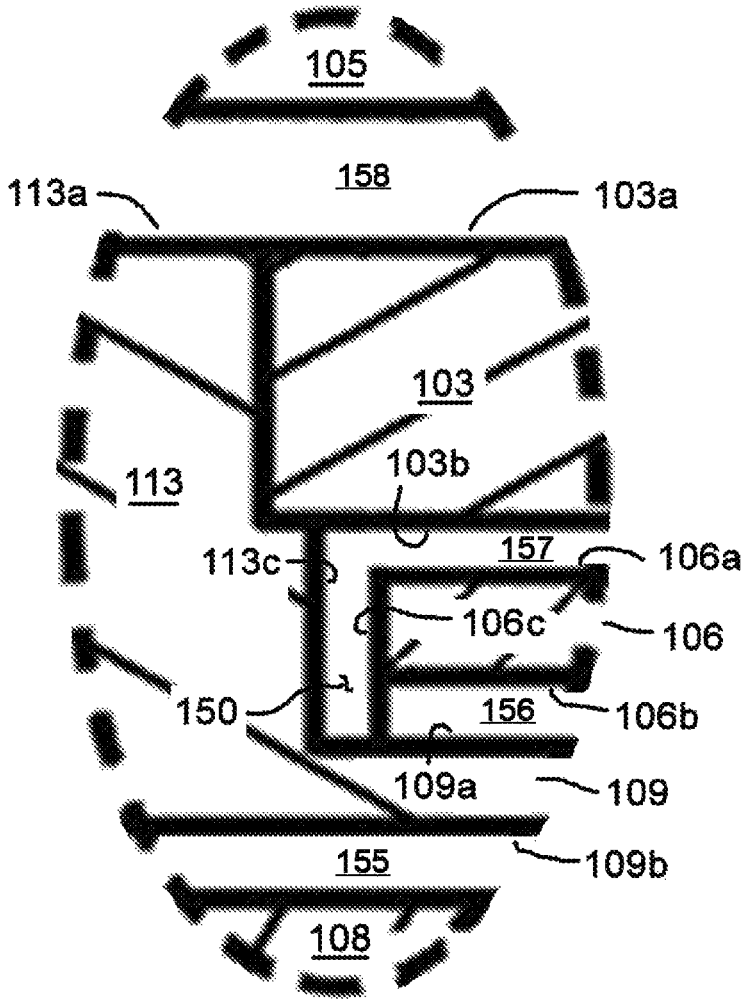
FIG. 7 is a partial cut-away view of the divider/combiner of FIG. 1 or FIG. 2 showing detail of the area of FIG. 1 or FIG. 2 indicated with reference numeral 7.

In the illustrated embodiments, the power divider-combiner 100 further includes a sidewall or exterior ground conductor 105 that has a central aperture receiving conductors 113 and 103, with a radial gap 158 between the ground conductor 105 and the outer surfaces of conductors 113 and 103 (see FIGS. 5, 6, and 7). The output RF connectors 101 are angularly spaced apart relative to each other, mounted to the sidewall 105, and their center conductors 102 pass through the sidewall 105. Further, the RF connector center conductors 102 define respective axes that are all perpendicular to coincident cylinder axes defined by the conductors 106 and 109, in some embodiments.

The power divider-combiner 100 further includes exterior ground conductor 115 and ground conductor flange 114, which are cylindrical in shape (FIGS. 12, 13), although other cross section shapes are possible. In some embodiments, (see FIG. 1) the exterior ground conductor 115 and flange 114 are fabricated as one piece. Other embodiments are possible such as, for example, conductor 115 soldered, brazed, or welded to flange 134 and ground conductor flange 114 as shown in FIG. 2 for the modified form of construction.

Figure 8:
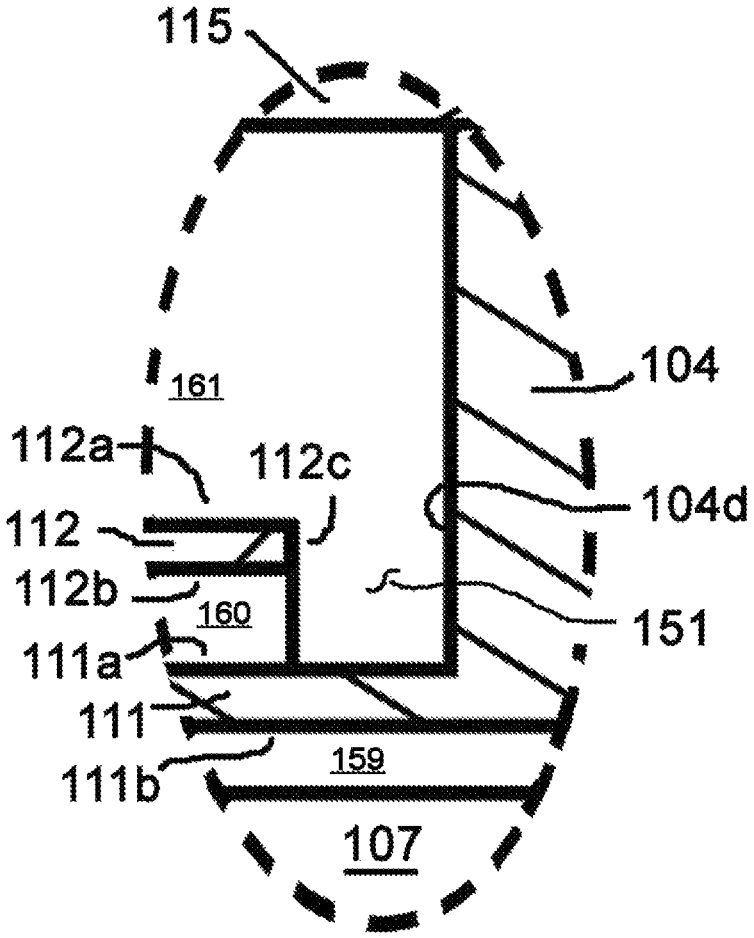
FIG. 8 is a partial cut-away view of the divider/combiner of FIG. 1 or FIG. 2 showing detail of the area of FIG. 1 or FIG. 2 indicated with reference numeral 8.
Figure 9:
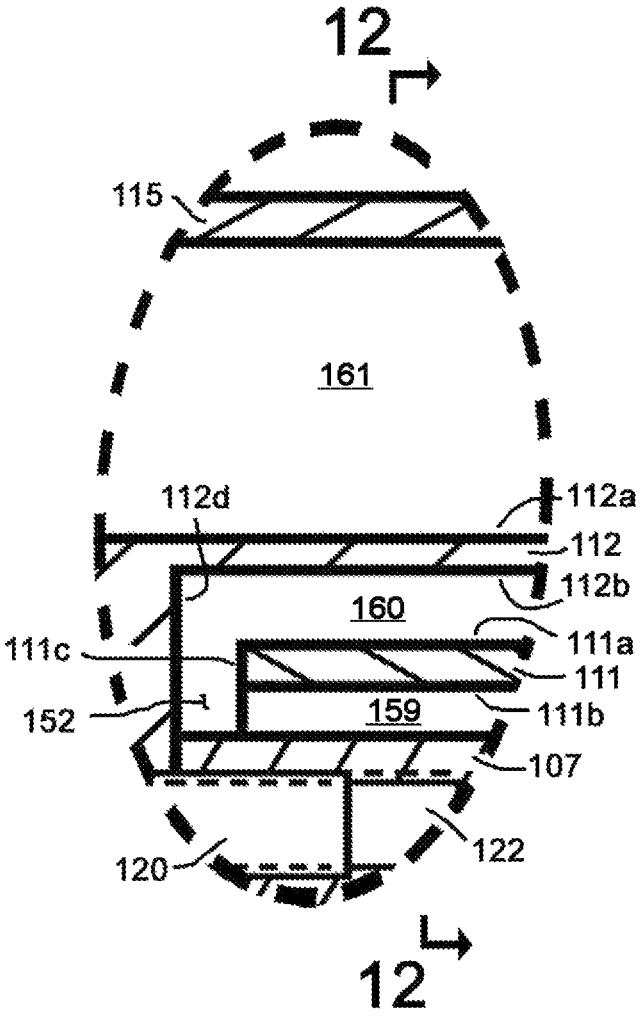
FIG. 9 is a partial cut-away view of the divider/combiner of FIG. 1 or FIG. 2 showing detail of the area of FIG. 1 or FIG. 2 indicated with reference numeral 9.
Figure 12:
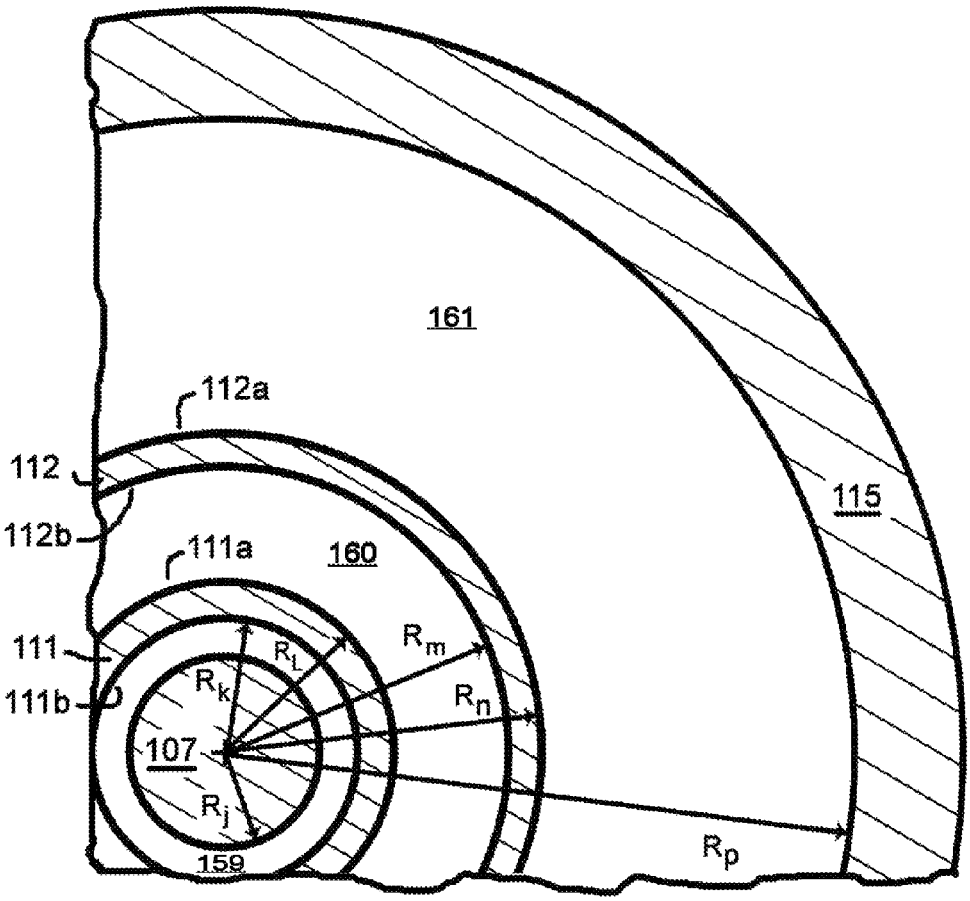
FIG. 12 is a sectional view taken along line 12-12 of FIG. 9.
Figure 13:
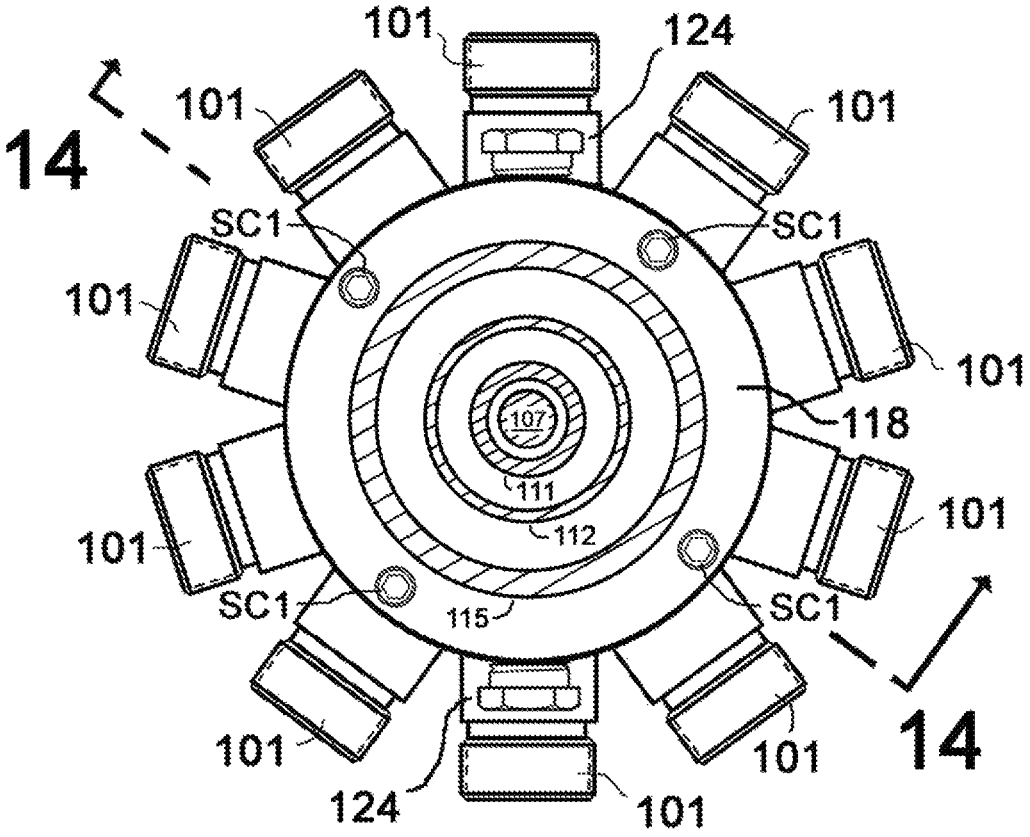
FIG. 13 is an end view and sectional view taken along line 13-13 of FIG. 1 or FIG. 2.

In various embodiments, a radial gap 161 is defined between the outer surface of cylindrical conductor 112 and the inner surface of ground conductor 115 (see FIGS. 8, 9, and 12). Further, in various embodiments, the outer surface of cylindrical conductor 112 and inner surface of ground conductor 115, the outer surface of conducting cylinder 111 and the inner surface of cylindrical conductor 112, the outer surface of main center conductor 107 and the inner surface of cylindrical conductor 111, the outer surface of main center conductor 108 and the inner surfaces of cylindrical conductors 113 and 109 define four unit element (quarter-wave) coaxial transmission lines. The outer surface of conductor 109 and the inner surface of cylindrical conductor 106, the outer surface of conductor 106 and the inner surface of cylindrical conductor 103 together define a single nested unit element (quarter-wave at mid-band) coaxial transmission line. The outer surface of the conductor 103 and the inner surface of the ground conductor 105 and their connection to the flange 104 define a unit element (quarter-wave at mid-band) transmission line shorted shunt stub 154 (see FIGS. 24, 25).

Figure 3:
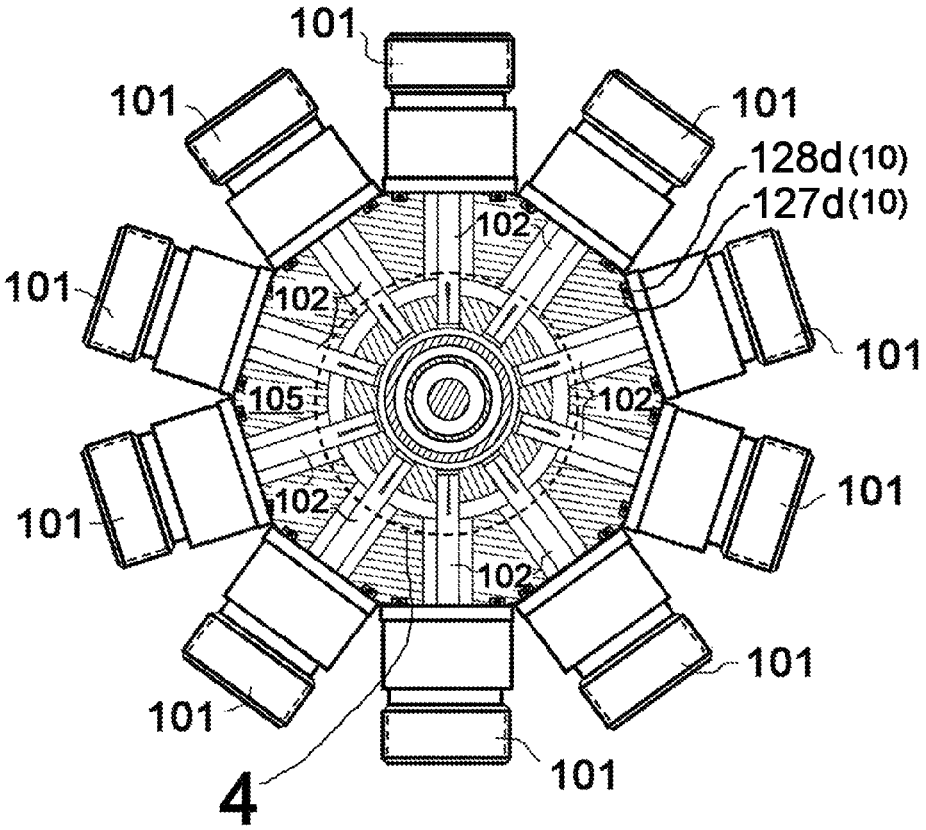
FIG. 3 is a sectional view taken along line 3-3 of FIG. 1 or FIG. 2.
Figure 4:
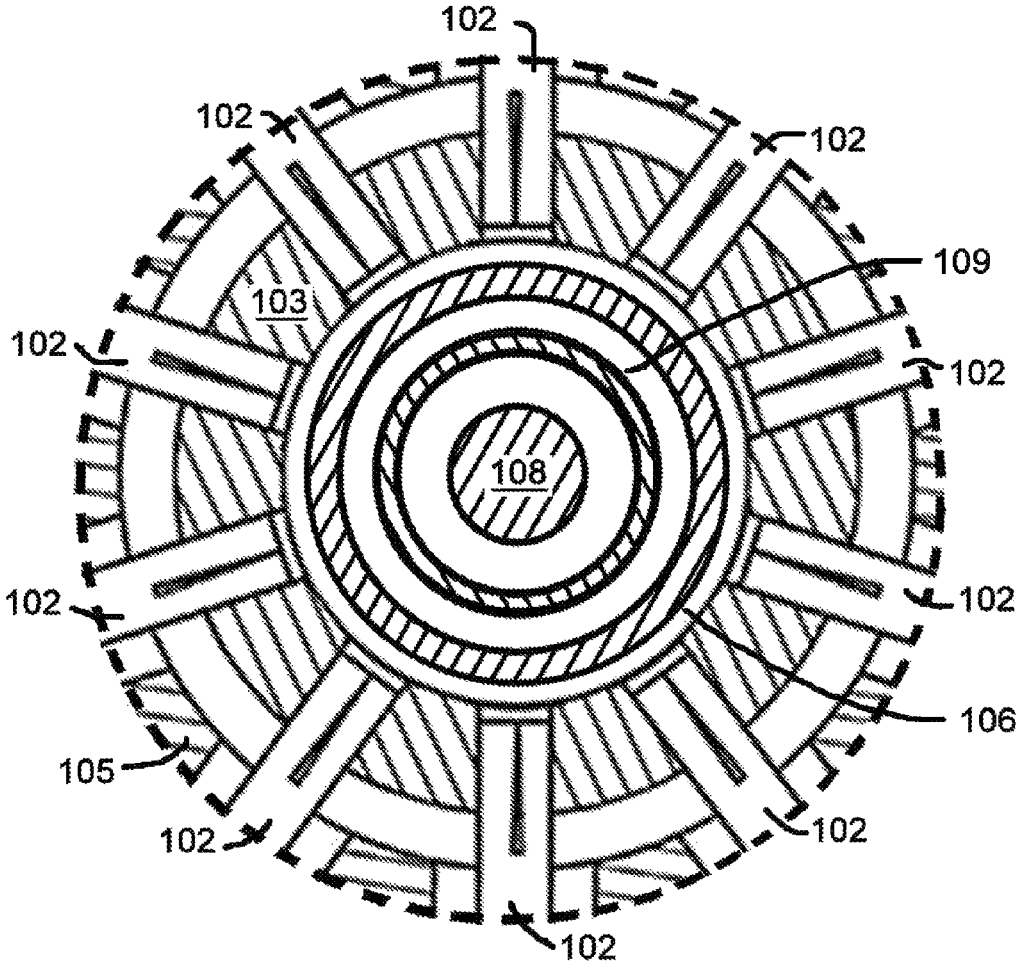
FIG. 4 is a partial cut-away view of the divider-combiner of FIG. 3.

In the illustrated embodiments, FIG. 1 shows the power divider-combiner 100 further includes a circular O-ring groove 127*a* in a forward surface of input port flange 118, and an O-ring 128*a* in the groove 127*a*, so the O-ring 128*a* sits between and engages the input port flange 118 and the input RF connector 119. In the embodiments shown in FIG. 2, the forward surface of the 1⅝ EIA flange 134 includes a circular O-ring half-groove 127*e* that engages a customer-supplied O-ring 138, which is simultaneously engaged by a corresponding half-groove 137 within the customer coax 1⅝ EIA mating flange 136. In the illustrated embodiments, the power divider-combiner 100 further includes a circular O-ring groove 127*b* in a forward surface of inner flange 104, and an O-ring 128*b* in the groove 127*b*, so the O-ring 128*b* sits between and engages the cylindrical ground conductor flange 114 and the flange 104. In the illustrated embodiments, the power divider-combiner 100 further includes a circular O-ring groove 127*c* in a forward surface of ground conductor 105, and an O-ring 128*c* in the groove 127*c*, so the O-ring 128*c* sits between and engages the ground conductor 105 and the flange 104. In the illustrated embodiments, the power divider-combiner 100 further includes angularly spaced-apart circular O-ring grooves 127*d* in an outer surface of the sidewall 105, and O-rings 128*d* in the grooves 127*d*, so the O-rings 128*d* sit between and engage the sidewall 105 and the output port connectors 101. The grooves 127*d* and O-rings 128*d* are also shown in FIG. 3. Instead of a groove, in the illustrated embodiments, the outer back plate 110 has a circular 45 degree chamfer 129 in a forward facing radially exterior cylindrical surface, and the power divider-combiner 100 further includes an O-ring 128*e* in the chamfer 129, so the O-ring 128*e* sits between and engages the outer back plate 110 and a rearward facing surface of the sidewall 105. In the illustrated embodiments, O-ring 128*f* engages a circular O-ring groove 127*f* located within the head of cap screw SC5 (see FIGS. 14, 15, 27 and 28) and sits between the rear back plate 110 and the head of cap screw SC5. In the illustrated embodiments, O-ring 128*g* engages a circular O-ring groove 127*g* located within the head of cap screw SC4 (see FIGS. 14, 16, 27, and 28) and sits between rear flange 110 and the head of cap screw SC4.

It should be apparent that when an O-ring is provided in a groove of one component that faces another component, the groove could instead be provided in the other component. For example, the groove 127*c* could be provided in the rearward face of flange 104 instead of in the forward face of ground conductor 105. Also, an O-ring groove containing an O-ring may be included within the flange of input RF connector 119, thereby eliminating the need for O-ring groove 127*a* and O-ring 128*a*. Additionally, an O-ring groove containing an O-ring may be included within the flange of output RF connector 101, thereby eliminating the need for O-ring groove 127*d* and O-ring 128*d*.

In the illustrated embodiments, the power divider-combiner 100 further includes threaded bores or apertures 125 extending inwardly from the radially exterior cylindrical surface of the sidewall 105. In the illustrated embodiments, the divider-combiner 100 further includes smaller diameter bores, passageways, or apertures 126, aligned with the bores 125 in the illustrated embodiments, and extending from the bores 125 to a gap between the sidewall 105 and the cylindrical conductor 113. In the illustrated embodiments, there are two bores 125 and they are ⅛ NPT threaded bores. In the illustrated embodiments, the power divider-combiner 100 further includes threaded sealing plugs 124 threadedly received in the bores 125. One or both of the plugs 124 may be removed and replaced with a pressure valve such as, for example, a Schrader (e.g., bicycle tube) pressure valves so that dry Nitrogen or arc suppression gas mixture may be introduced into the interior of the divider-combiner 100 via the bores 126. Other types of pressure valves may be used, such as Presta or Dunlop valves, for example.

There are several reasons why the O-rings 128*a-g*, threaded bores 125, bores 126, and plugs 124 are advantageous. In FIG. 1, with both plugs 124 replaced with Schrader valves 142 by the customer, dry Nitrogen can be introduced through one Schrader valve and allowed to exit the other Schrader valve so as to purge moisture-laden air from the sealed divider/combiner interior.

Figure 28:
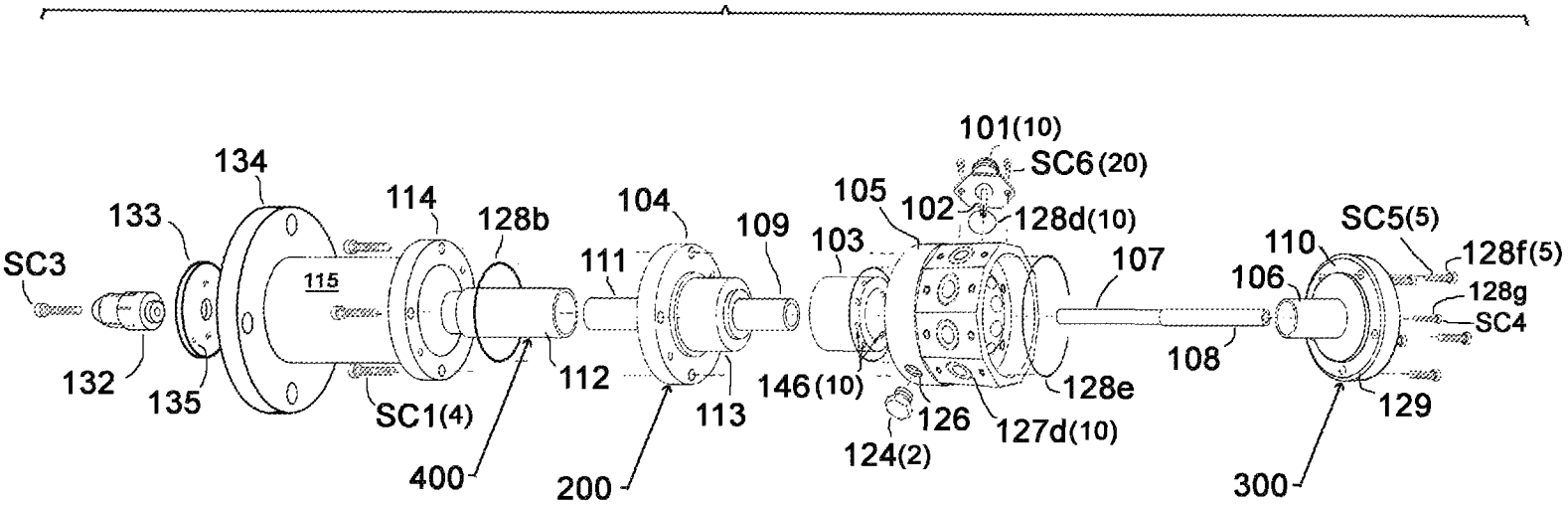
FIG. 28 is an exploded perspective view of the power divider/combiner as shown in FIG. 2.

Consider a divider-combiner at one end of a long coax cable going up through a broadcast or radar tower to another adapter connected to an antenna, for example. Winter environment can cause moisture condensation which may result in arcing within the cable assembly during broadcast operation. To prevent this from occurring, dry nitrogen (or dehumidified air) is introduced via the Schrader valve connection at one end of the cable assembly, which exits through another Schrader valve at the far end of the cable assembly. Referring to FIGS. 2, 23, and 28, the ventilation aperture 135 in the 1⅝ EIA dielectric 133 permits gas flow throughout the cable system. The O-rings 128*a-g* and at the EIA flange interfaces protect the cable interior from moisture (cable jacket condensation or rainfall onto the cable system leading to the tower, for example) as well as preventing any leakage of the dry nitrogen flow.

Higher-pressure gas, introduced by means of the Schrader valves and an external gas source connection 143 (FIG. 2), increases the air dielectric breakdown strength within the divider-combiner 100. The entire system including cables may then withstand higher microwave power transmission.

In some microwave radar and countermeasure systems used in fighter aircraft, the microwave waveguide and cable system components are pressurized at ground level. For example, in FIG. 1 the 7-16 DIN input connector O-ring 128*a* and the customer cable which connects to it completely seals the forward end of the divider-combiner. Both plugs 124 may be replaced with Schrader valves 142 and the divider-combiner interior then purged with moisture-free pressurized nitrogen or other pressurized gas mixture. Then the gas feed connection 143 is removed, the Schrader valves 142 are capped, and the divider/combiner 100 is expected to hold pressure for the duration of the flight mission. The O-rings 128*a-g* help maintain this interior pressure.

The O-rings 128*a-g* provide containment of high-breakdown strength gas, such as sulfur hexafluoride. The O-rings 128*a-g* keep this expensive (and possibly toxic) gas contained in the divider-combiner 100. The divider-combiner 100 with O-rings 128*a-g* and built with a 7-16 DIN or Type SC input connector 119 is sealed, in some embodiments. There are no ventilation holes in the connector dielectric. The divider-combiner 100 then must use two Schrader valves 142 mounted so that the divider-combiner's interior may be successfully filled with the arc-protection gas compound.

Referring to FIG. 1, the electrical short 104*a* is located at reference plane a-a, and the shorted shunt stub 154 (see FIGS. 24, 25) makes connection to the output connector center conductors 102 (see FIGS. 5 and 6) at reference plane b-b.

Figure 24:
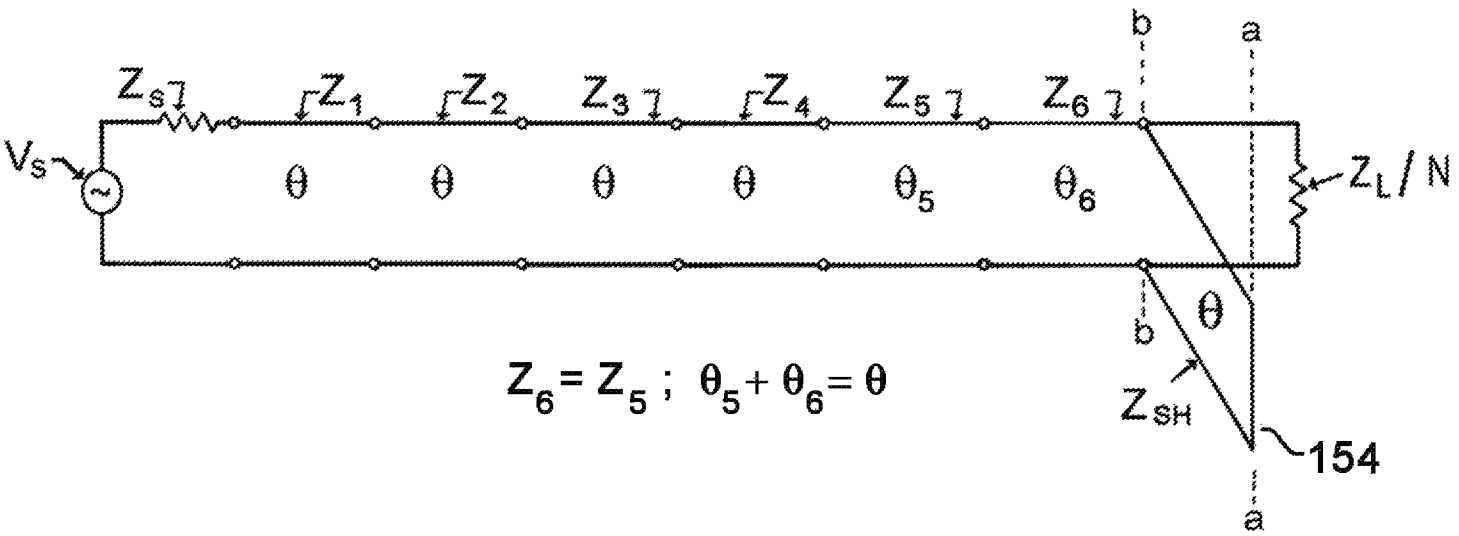
FIG. 24 is a basic equivalent circuit diagram for the divider/combiner shown in FIG. 1 or FIG. 2, when it is operated as a power divider.

Collectively, the four unit element transmission lines with characteristic impedances $Z_1$, $Z_2$, $Z_3$, $Z_4$, and the two half-unit element transmission lines $Z_5$, $Z_6$ (where $Z_6=Z_5$) and the shorted shunt stub unit element with characteristic impedance $Z_{SH}$ are electrically modeled, in a generalized form, as a passband filter equivalent circuit shown in FIG. 24. A passband is a portion of the frequency spectrum that allows transmission of a signal with a desired minimum insertion loss by means of some filtering device. In other words, a passband filter passes a band of frequencies to a defined passband insertion loss vs. frequency profile. Desired filter passband performance is achieved by a four-step process:

1) Given a source impedance quantity $Z_S$, divider quantity (number of outputs) N, load impedance quantity $Z_L$/N and desired passband a) bandwidth, and b) input port return loss peaks within the passband, calculate the unit element transmission line characteristic impedances $Z_1$, $Z_2$, $Z_3$, $Z_4$, $Z_5$ and unit element shorted shunt stub characteristic impedance value $Z_{SH}$ (see FIG. 24). This may be accomplished, as one approach, using the design theory as described in M. C. Horton and R. J. Wenzel, "General theory and design of quarter-wave TEM filters," IEEE Trans. on Microwave Theory and Techniques, May 1965, pp. 316-327.

2) After determining the above desired electrical transmission line characteristic impedances, then find corresponding diameters for the outer surface of conductor 112, inner and outer diameters of cylindrical conductors 111, and 112, the diameters of main center conductors 107 and 108, the inner and outer diameters of conducting cylinders 109 and 106, and the inner diameter of conductor 103 which define unit element characteristic impedances $Z_1$, $Z_2$, $Z_3$, $Z_4$, $Z_5$, and $Z_6=Z_5$. In addition, the outer diameter of conductors 113 and 103 and the inner diameter of ground conductor 105 define the shorted shunt stub unit element characteristic impedance $Z_{SH}$. For example (referring to Section 12-12 FIG. 12), the characteristic impedance $Z_1$ is defined according to the formula $Z_1=60*\log_e(R_p/R_n)$ where quantity $R_p$ is the radius of the inner surface of the ground conductor 115, and where quantity $R_n$ is the radius of the outer surface 112*a* of the cylinder conductor 112. The characteristic impedance $Z_2$ is defined according to the formula $Z_2=60*\log_e(R_m/R_L)$ where quantity $R_m$ is the radius of the inner surface 112*b* of the conductor 112, and where quantity $R_L$ is the radius of the outer surface 111*a* of cylinder conductor 111. The characteristic impedance $Z_3$ is defined according to the formula $Z_3=60*\log_e(R_k/R_j)$ where quantity $R_k$ is the radius of the inner surface 111*b* of the conductor 111, and where quantity $R_j$ is the radius of the main conductor portion 107. Referring to Section 11-11 FIG. 11, the characteristic impedance $Z_4$ is defined according to the formula $Z_4=60*\log_e(R_b/R_a)$ where quantity $R_b$ is the radius of the inner surface 109*b* of the conductor 109, and where quantity $R_a$ is the radius of the main conductor portion 108. The characteristic impedance $Z_5$ is defined according to the formula $Z_5=60*\log_e(R_d/R_c)$ where quantity $R_d$ is the radius of the inner surface 106*b* of the conductor 106, and where quantity $R_c$ is the radius of the outer surface 109*a* of conductor 109. The characteristic impedance $Z_6$, set equal to the quantity $Z_5$, is defined according to the formula $Z_6=60*\log_e(R_f/R_e)$ where quantity $R_f$ is the radius of the inner surface 103*b* of the conductor 103, and where quantity $R_e$ is the radius of the outer surface 106*a* of conductor 106. Similarly, the characteristic impedance $Z_{SH}$ is defined according to the formula $Z_{SH}=60*\log_e(R_h/R_g)$ where quantity $R_h$ is the radius of the inner surface of the ground conductor 105, and quantity $R_g$ is the radius of the outer surface 103*a* of conductor 103. The outer surface 113*a* (see FIG. 7) and outer surface 103*a* (FIGS. 1, 2) have the same radius $R_g$. The above expressions for impedances $Z_1$, $Z_2$, $Z_3$, $Z_4$, $Z_5$, $Z_6=Z_5$ and $Z_{SH}$ assume air or vacuum-dielectric, but other dielectric materials may be used along the lengths of transmission lines with characteristic impedances corresponding to $Z_1$, $Z_2$, $Z_3$, $Z_4$, $Z_5$, $Z_6=Z_5$, and $Z_{SH}$, such as (but not limited to) Teflon, boron nitride, beryllium oxide, or diamond, for example.

Figure 17:
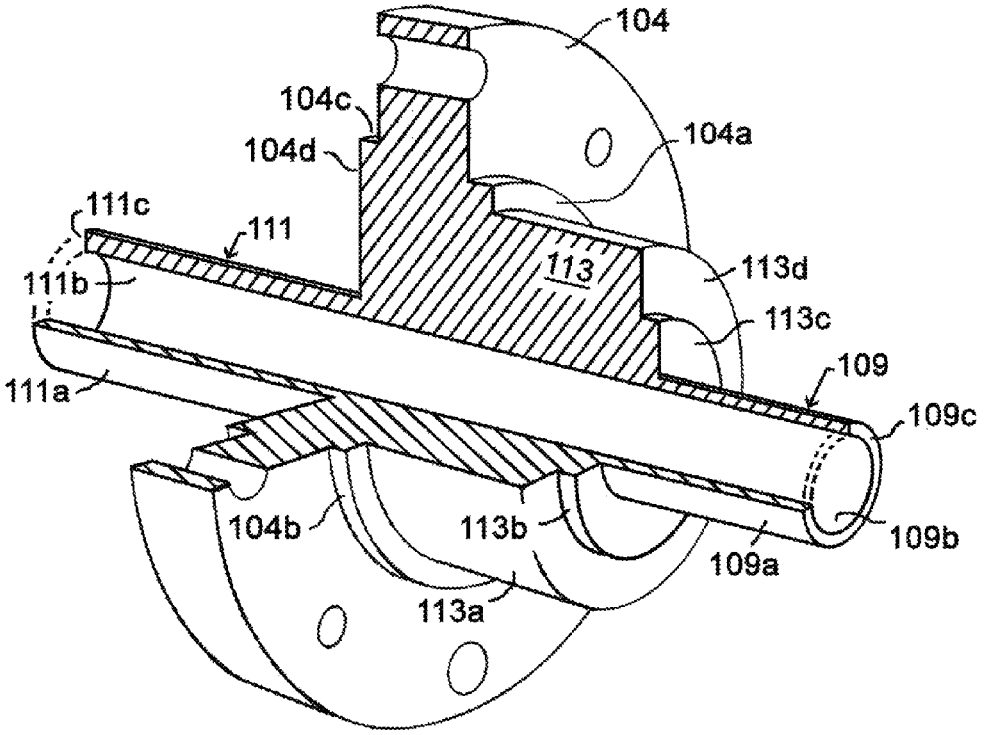
FIG. 17 is a perspective view of a conductor included in the divider/combiner of FIG. 1, partly in section.
Figure 29:
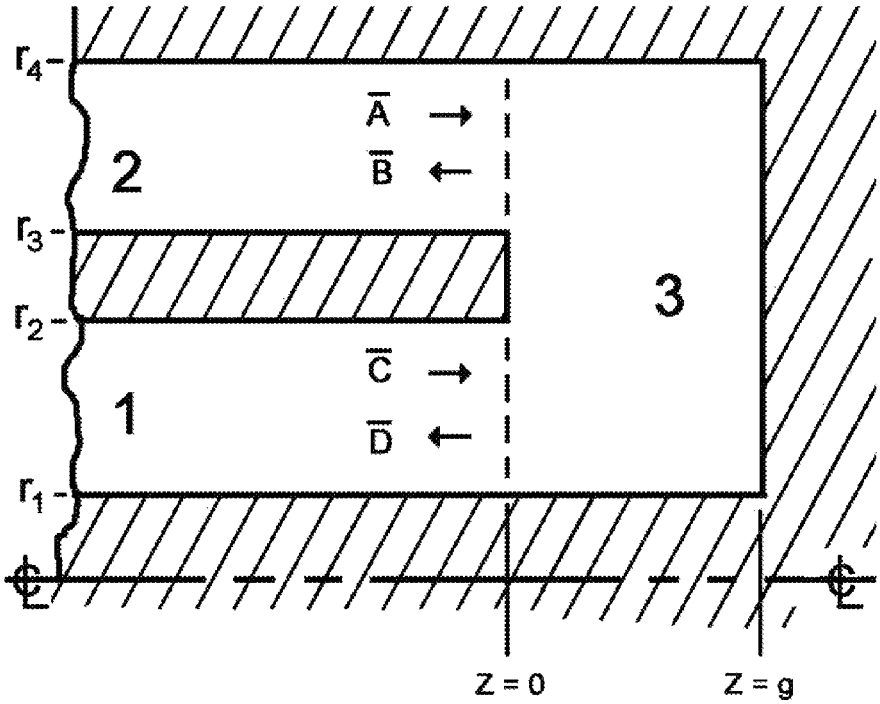
FIG. 29 is a section of nested coaxial line that defines mode amplitude reflection coefficients.

3) Referring to FIG. 8, 17, 20 or 21 and the equivalent circuit FIG. 24, the radial transmission line gap 151 formed between conductor surfaces 112*c* and the forward facing surface 104*d* of inner flange 104 is adjusted so that the magnitude of the complex reflection coefficient at this junction is made as close as possible to the quantity $(Z_1/Z_2-1)/(Z_1/Z_2+1)$ over the passband frequency range $F_1$ to $F_2$. Referring to FIG. 9, 17, 20 or 21, the radial transmission line gap 152 formed between cylinder conductor surface 112*d* and the forward facing cylinder conductor surface 111*c* is adjusted so that the magnitude of the complex reflection coefficient at this junction is made as close as possible to the quantity $(Z_2/Z_3-1)/(Z_2/Z_3+1)$ over the passband frequency range F1 to F2. Referring to FIG. 5 or 6, 17, and 19, the radial transmission line gap 145 formed between cylinder conductor 109 surface 109*c* and the forward facing-surface 110*c* of the backplate 110 is adjusted so that the magnitude of the complex reflection coefficient at this junction is made as close as possible to the quantity $(Z_4/Z_5-1)/(Z_4/Z_5+1)$ over the passband frequency range F1 to F2. Referring to FIGS. 7, 17, and 19, the radial transmission line gap 150 formed between cylinder conductor 106 forward facing surface 106*c* and the cylinder conductor 113 rearward facing surface 113*c* is adjusted so that the magnitude of the complex reflection coefficient at this junction is made as close to zero as possible over the passband frequency range F1 to F2, because we are setting $Z_6=Z_5$. Referring to FIG. 5 or 6, 18 and 19, the radial transmission line gap 144 formed between conductor surfaces 103*c* and the forward facing surface 110*a* of back plate 110 is adjusted so that the magnitude of the complex reflection coefficient at this junction is made as close as possible to the quantity $(Z_{SH}/Z_3-1)/(Z_{SH}/Z_3+1)$ over the passband frequency range F1 to F2. FIG. 29 shows two nested coaxial transmission lines 1 (inner line) and 2 (outer line) with a third shorted coaxial line. All three coaxial lines are each modeled using a combination of propagating TEM and evanescent TM modes. Complex reflection coefficients $\rho_1$ and $\rho_2$ at a nested coax junction (see FIG. 29) may be modeled, as one approach, by first using a field analysis formalism as presented by J. R. Whinnery, H. W. Jamieson, and T. E. Robbins, "Coaxial line discontinuities," Proceedings of the I.R.E., November 1944, pp. 695-710, and then creating a mode-matching amplitude matrix M (FIG. 29) using the formalism as presented by H. Patzelt, and F. Arndt, "Double-plane steps in rectangular waveguides and their application for transformers, irises, and filters," IEEE Trans. Microwave Theory Tech., vol. MTT-30, pp. 771-776, May 1982.

Figure 25:
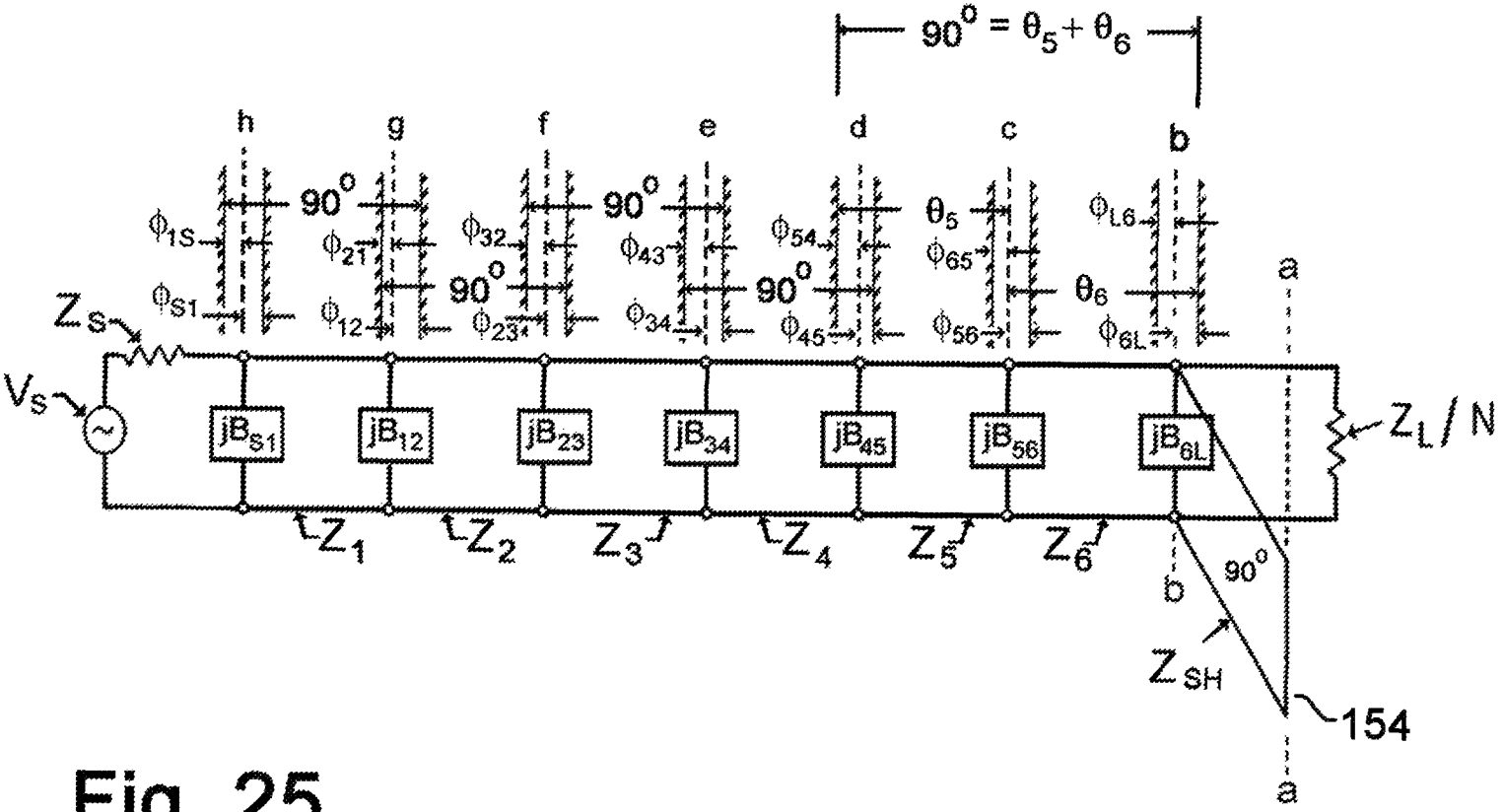
FIG. 25 is a more detailed equivalent circuit diagram for the divider/combiner shown in FIG. 1 or FIG. 2, when it is operated as a power divider.

4) Having determined at each coax line nested junction the complex reflection coefficients $\rho_1$ and $\rho_2$ in the manner described above, the phases $\varphi_l$ and $\varphi_2$ at each successive nested junction are used to adjust the physical length of each coax transmission line to preserve unit element phase length (90 degrees at the passband mid-band frequency) for each section with respective characteristic impedance $Z_1$, $Z_2$, $Z_3$, $Z_4$, and $Z_{SH}$, and to preserve 90 degree phase length as the total phase for the composite folded transmission line with characteristic impedances $Z_5$, $Z_6$, where $Z_6=Z_5$. This may be accomplished, as one approach, using the technique outlined in FIGS. 6.08-1 "Length corrections for discontinuity capacitances," from G. Matthaei, L. Young, and E. M. T. Jones, *Microwave Filters, Impedance-matching Networks, and Coupling Structures*, Artech House Books, Dedham, M A, 1980. The detailed electrical equivalent circuit shown in FIG. 25 shows the nested coax line junction reactances $jB_{S1}$, $jB_{12}$, . . . , $jB_{56}$, and $jB_{6L}$ and the corresponding phase corrections $\varphi_{1S}$, $\varphi_{S1}$, $\varphi_{12}$, $\varphi_{21}$, . . . , $\varphi_{L6}$, $\varphi_{6L}$ needed to achieve purely real reflection coefficients at each junction at mid-band. For a mid-band frequency equal to 1.8 GHz, for example, the physical free space quarter-wave length is 1.639 inches. But after using the Matthaei, Young, and Jones procedure to preserve 90 degree phase spacing between junctions at mid-band, the corresponding unit element physical lengths become, approximately, 1.549", 1.252", 1.632", and 1.493" respectively for each of the above nested coaxial transmission line center conductors corresponding to characteristic impedances $Z_1$, $Z_2$, $Z_3$, and $Z_4$.

Figure 26:
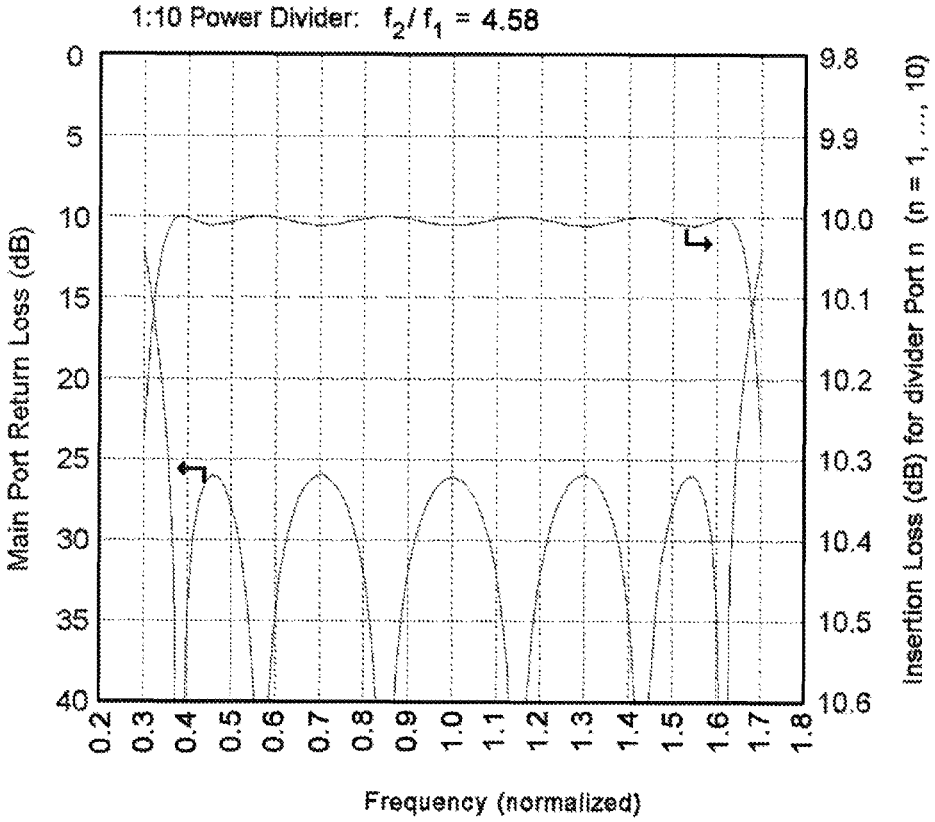
FIG. 26 is a graph showing typical predicted input port return loss and output port insertion loss vs. normalized frequency for embodiments of the divider-combiner of FIG. 1 or FIG. 2 that have one input port and ten output ports (when being used as a power divider).

As an example, given: N=10, $Z_S=Z_L=50$ ohms, 26 dB return loss peaks are desired for a bandwidth $F_2/F_1=4.58$, where $F_1$, $F_2$ represent the lower and upper edges of the passband, respectively. Using the Horton & Wenzel technique, unit element characteristic impedances $Z_1$, $Z_2$, $Z_3$, $Z_4$, $Z_5$, $Z_6=Z_5$, and the shorted shunt stub unit element characteristic impedance value $Z_{SH}$ were found. FIG. 26 shows calculated response using the derived characteristic impedances of the equivalent circuit in FIG. 24. Cross-section dimensions throughout the filter device were then determined so as to achieve these unit element characteristic impedances. The radial line gaps 151 (FIG. 8), 152 (FIG. 9), 145 (FIG. 5 or 6), 150 and 144 (FIG. 5 or 6) were optimized to give as closely as possible the correct magnitude, as described earlier, of the complex reflection coefficients calculated for each nested junction, and the physical lengths of each unit element were adjusted to achieve quarter-wave phase length at mid-band. The length between reference plane b-b and the forward-looking face of flange 118 is 3.46" for the divider-combiner 100 (FIG. 1). In comparison, for a non-nested design, the length would be at least 9.8 inches, using six quarter-wave unit elements in series. The calculated scattering parameters $S_{11}, \ldots, S_{n1}$ plotted in FIG. 26 characterize a Chebyshev filter response throughout the passband $F_1$ through $F_2$. The Horton & Wenzel technique can also be used to find different values $Z_1$, $Z_2$, $Z_3$, $Z_4$, $Z_5$, $Z_6=Z_5$ and $Z_{SH}$ to achieve other types of filter response such as, for example, maximally flat filter response.

Various conductive materials could be employed for the conductive components of the power divider-combiner 100. For example, in some embodiments, the parts (other than those parts for which materials have been already described) are fabricated from 6061 alloy aluminum. For corrosion resistance, some of these parts may be a) alodine coated, or b) electroless nickel flash-coated and MILspec gold plated. In other embodiments, parts may be fabricated from brass, magnesium or beryllium alloys, or conductive plastic which may also be MILspec gold plated. Another possibility is MILspec silver plating, with rhodium flash coating to improve corrosion resistance.

Figure 15:
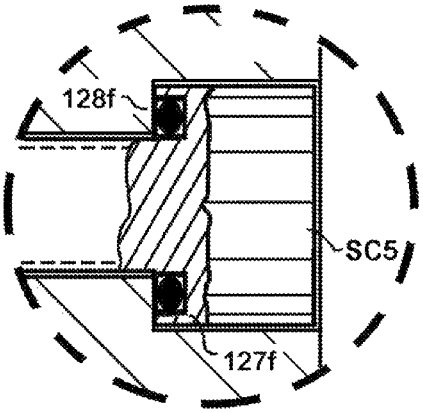
FIG. 15 is a partial cut-away view of embodiments of the divider/combiner of FIG. 1, showing detail of the area of FIG. 14 indicated with reference numeral 15 including a cap screw O-ring seal.
Figure 16:
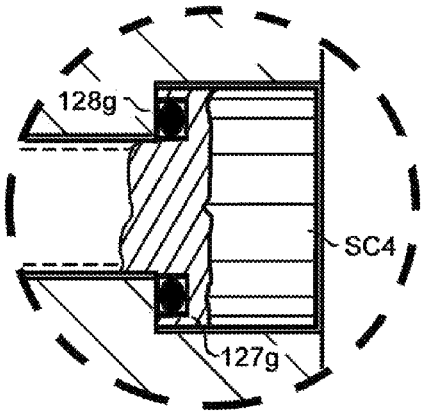
FIG. 16 is a partial cutaway view of embodiments of the divider/combiner of FIG. 1, showing detail of the area of FIG. 14 indicated with reference numeral 16 including a cap screw O-ring seal.
Figure 14:
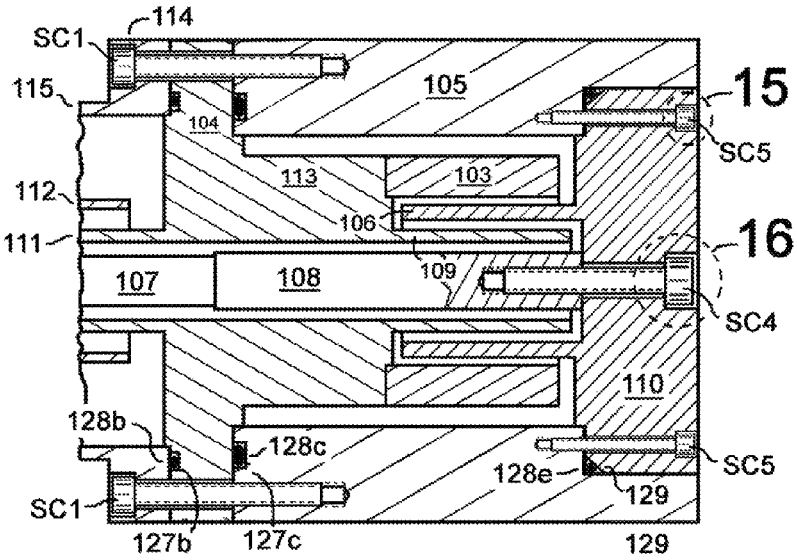
FIG. 14 is a sectional view taken along line 14-14 of FIG. 13.
Figure 27:
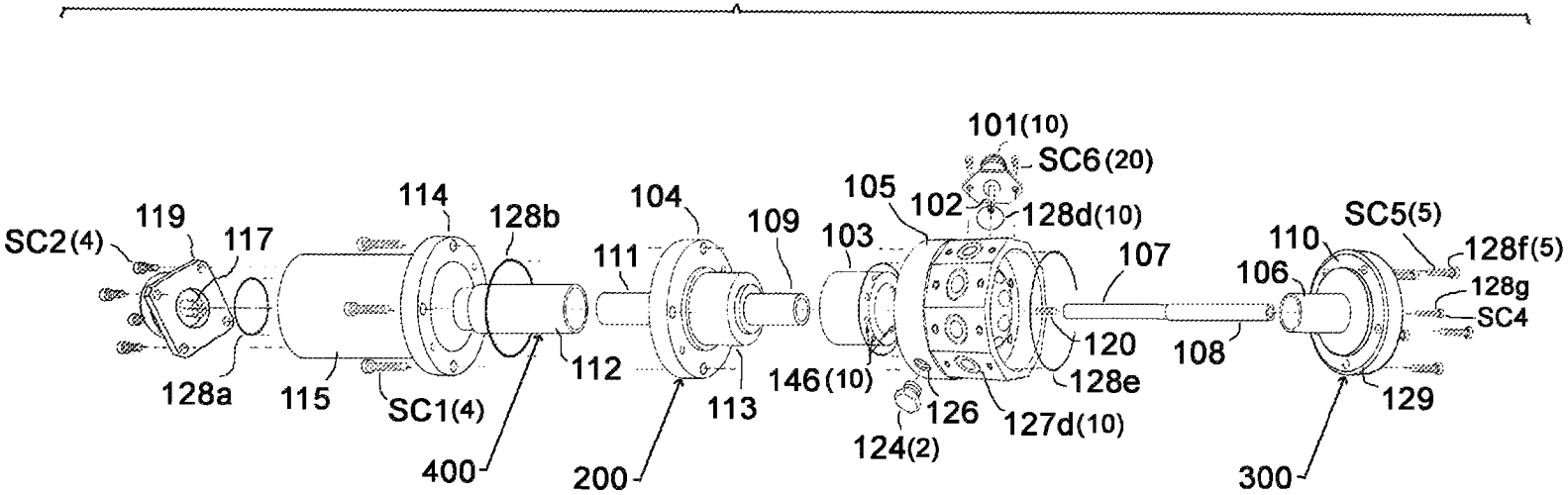
FIG. 27 is an exploded perspective view of the power divider/combiner as shown in FIG. 1.

To better enable one of ordinary skill in the art to make and use various embodiments, FIG. 27 is an exploded view of the power divider-combiner 100 of FIG. 1. In the illustrated embodiments (see FIGS. 13, 14, and 27), the ground conductor flange 114 and the cylinder-flange 200 are mounted with four 8-32×0.75" socket head screws SC1 to the forward face of outer ground conductor 105. In the illustrated embodiments (see FIGS. 22, 27), the 7-16 DIN female RF connector 119 is mounted with four 4-40×0.25" socket head cap screws SC2 to the input connector flange 118. In the illustrated embodiments for the modified form of construction shown in FIG. 2, cap screw fastener SC3 captivates together the 1⅝ EIA center conductor bullet 132, dielectric disk 133, and the stepped conductor-cylinder assembly 400 to the main center conductor portion 107. Referring to FIGS. 14, 15, and 27, five 6-32×0.625" socket head screws SC5 each include an O-ring 128*f* contained in a groove 127*f* machined into the head of the cap screw (FIG. 15). Referring to FIGS. 14, 16, and 27, a single 8-32×¾" socket head screw SC4 includes an O-ring 128*g* contained in a groove 127*g* machined into the head of the cap screw (FIG. 16). In some embodiments, the screws SC4 and SC5 that are employed are obtained from ZAGO Manufacturing. In some embodiments, other types of screw fasteners can be used such as, for example, button head cap screws. Other fastener thread sizes, lengths, and materials or attachment methods can be employed.

The main center conductor 108 is bolted to surface 110*c* of the rear flange 110 using a single 6-32×¾" stainless steel cap screw SC4 (FIG. 1 or 2, 14, 19, and 27). Other size screws or other methods of attachment can be employed. Additionally, conductor 108 and rear flange 110, both which may be plated for soldering, are shown in FIG. 5 or 6 with solder fillet 148 after soldering, so as to improve thermal and electrical contact at this connection.

FIG. 17 shows a perspective view of a flange-cylinder assembly 200 in accordance with various embodiments. In the illustrated embodiments, the flange cylinder assembly 200 includes the conducting flange 104 and the conductor 113. In the illustrated embodiments, the flange 104 and the conductor 113 are machined from a common piece. In alternative embodiments, the flange 104 and conductor 113 are separate pieces that are thermally and electrically connected together. The conductor 113 is bolted, soldered, or brazed, or press fit onto conducting flange 104 in alternative embodiments. The outer conductive surface 113*a* of the conductor 113 is cylindrical or generally cylindrical in the illustrated embodiments. The inner surface 109*b* of the conductor 113 is conductive and is cylindrical or generally cylindrical in the illustrated embodiments. The flange cylinder assembly 200 includes a first end defined by the flange 104 and a second end 113*c*, defined by the conductor 113. The end 113*c* defines a radial line conductor surface as described above. The flange 104 includes an alignment hub outer surface 104*b* and the previously described surface 104*a* defines a short circuit conducting surface. The outer surface 104*b* has an outer cylindrical surface having a diameter that is larger than the diameter of the outer cylindrical surface 113*a* of the conductor 113. The flange 104 also has an outer cylindrical surface having a diameter greater than the diameter of the surface 104*b*.

Figure 18:
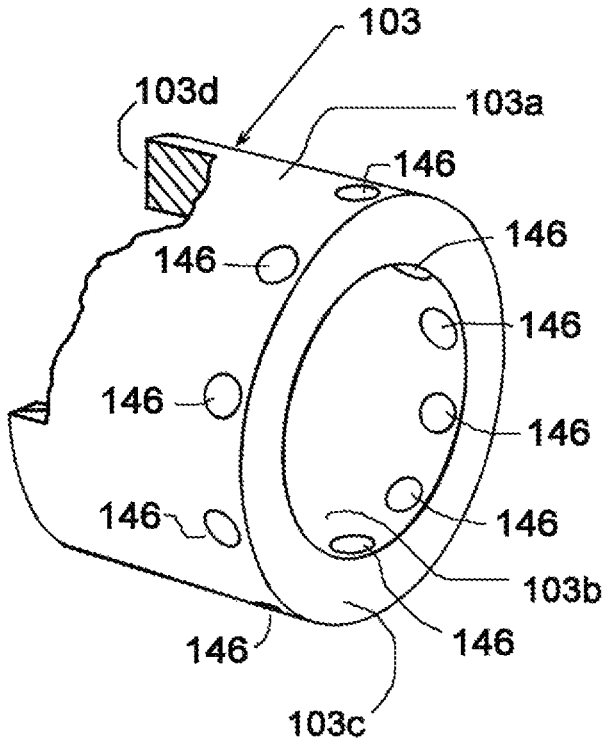
FIG. 18 is a perspective view of a conductor included in the divider/combiner of FIG. 1, partly in section.
Figure 19:
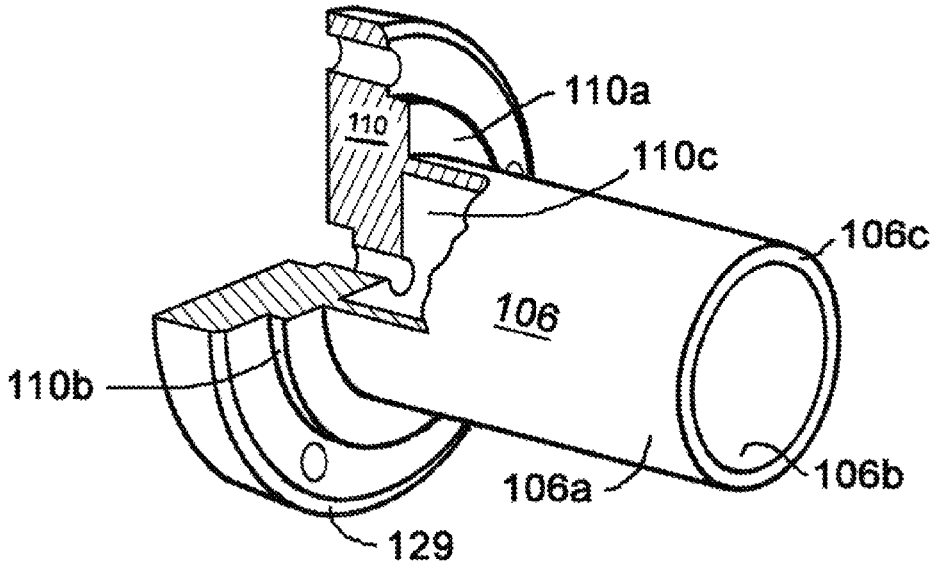
FIG. 19 is a perspective view of a conductor included in the divider/combiner of FIG. 1, partly in section.

FIG. 18 shows a perspective view of conductive cylinder 103 in accordance with various embodiments. In the illustrated embodiments, inner surface 103*c* mounts onto an alignment hub 113*b* of flange-cylinder 200 (FIG. 17), and forward surface 103*d* is soldered, brazed, or welded to rearward facing surface 113*d* of flange-cylinder 200 (FIG. 17). Previously described apertures 146 for receiving center conductors 102 are shown.

Figure 22:
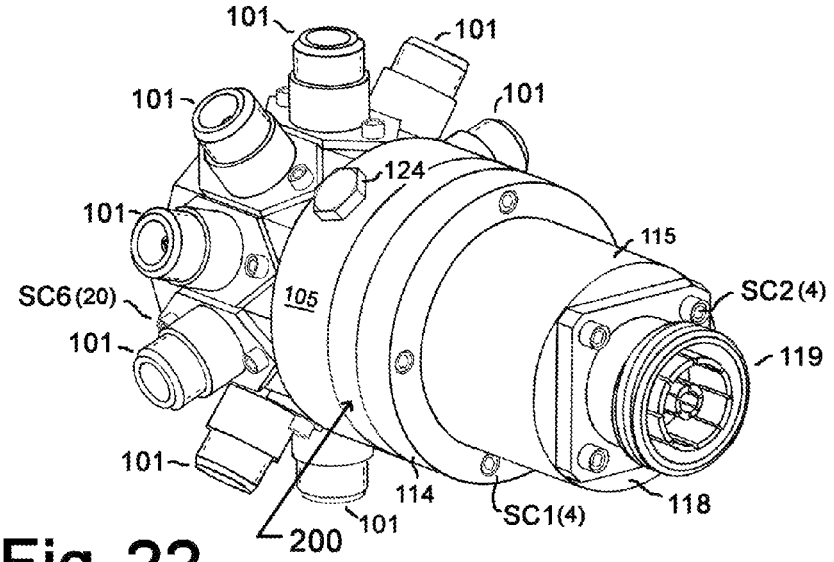
FIG. 22 is a perspective view of the divider-combiner of FIG. 1.

FIG. 22 shows a perspective view of the power divider-combiner 100 of FIG. 27 after assembly.

FIG. 23 shows a perspective view of the power divider-combiner 100 of FIG. 28 after assembly.

In the filter circuit synthesis technique as presented in the Horton & Wenzel reference, a desired circuit response (return loss over a passband as shown in FIG. 16, for example) results from the synthesis of transmission line characteristic impedances for a sequence of one or more unit element (substantially quarter-wave at the mid-band frequency $f_O$) transmission lines followed by a unit element shorted shunt stub transmission line connected in parallel with circuit load $Z_L/N$, as shown in FIG. 18 for this example.

Figure 10:
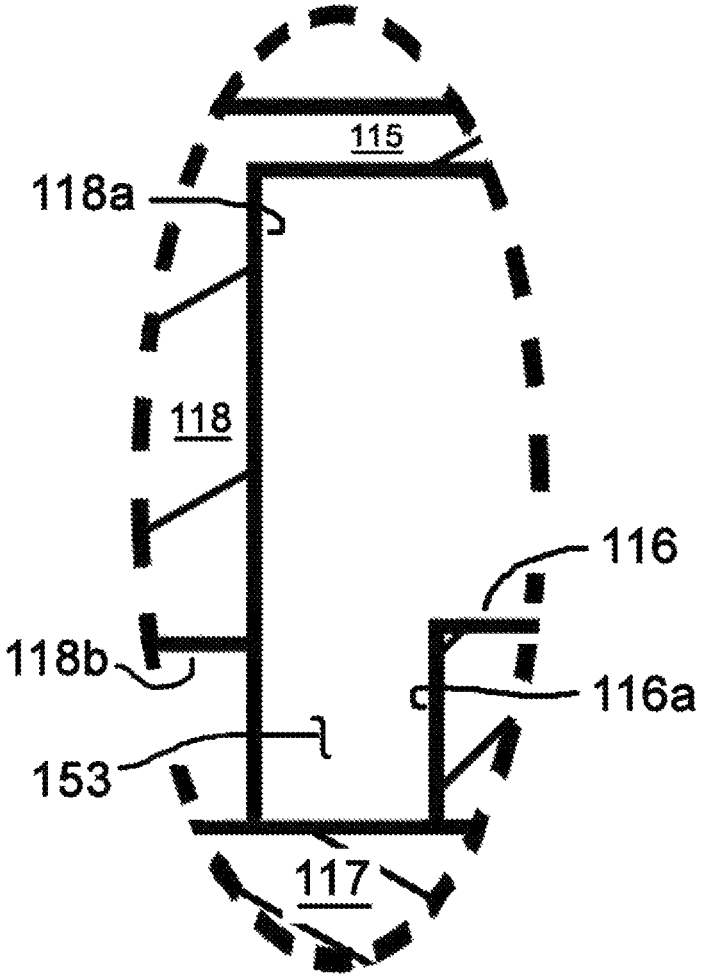
FIG. 10 is a partial cut-away view of the divider/combiner of FIG. 1 or FIG. 2 showing detail of the area of FIG. 1 or FIG. 2 indicated with reference numeral 10.
Figure 11:
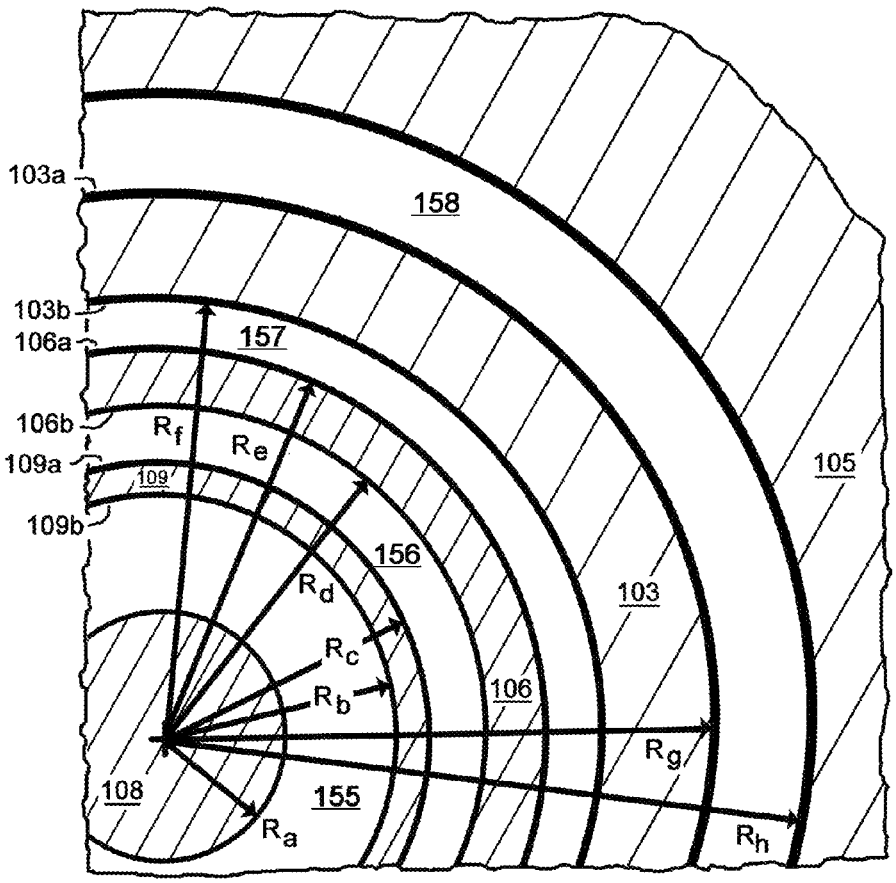
FIG. 11 is a sectional view taken along line 11-11 of FIG. 5.

Referring to FIGS. 1 and 10, the inner surface 118*b* of flange 118 and the outer surface of bullet 117 form a transmission line with characteristic impedance $Z_S$=50 ohms. The inner surface of ground conductor 115 and the outer surface of conductor 116 also form a transmission line with a characteristic impedance equal to $Z_S$. Other input connector impedances $Z_S$ are possible, such as, for example, 75 ohms. Using the analysis approach cited earlier, the radial line gap 153 (FIG. 10) formed by the rearward facing surface 118*a* and forward facing surface 116*a* is adjusted so that the magnitude of the complex reflection coefficient is approximately equal to zero over the passband frequency range F1 to F2. Referring to FIG. 1 or 2, and 9 and the equivalent circuit shown in FIG. 24, the outer conductor surface 112*a* of conductor 112 and the inner surface of conductor 115 form a unit element (substantially quarter-wave at the mid-band frequency) transmission line with characteristic impedance $Z_1$. The outer surface 111*a* of conductor 111 and the inner surface 112*b* of conductor 112 form a unit element transmission line with characteristic impedance $Z_2$. The outer surface of main conductor portion 107 and the inner surfaces 111*b* of the conductor 103 and of inner flange 104 form a unit element transmission line with characteristic impedance $Z_3$. The outer surface of main conductor portion 108 and the inner surfaces of the conductors 113 and 109 form a unit element transmission line with characteristic impedance $Z_4$. The outer surface 109*a* of conductor 109 and the inner surface 106*b* of conductor 106 form a transmission line with characteristic impedance $Z_5$. The outer surface 106*a* of conductor 106 and the inner surface 103*b* of conductor 103 form a transmission line with characteristic impedance $Z_6$, which is set equal to $Z_5$. The combined phase length of the above described transmission lines with impedances $Z_5$ and $Z_6$ (where $Z_6=Z_5$) forms a unit element. 1) Electrical reference plane a-a (FIGS. 24, 25) corresponds to the physical reference plane a-a shown in FIG. 1, where the flange 104 conducting surface 104*a* in FIG. 17 serves as the short circuit for a unit element shorted shunt stub 154 (FIGS. 24, 25). 2) Electrical reference plane b-b (FIGS. 24, 25) corresponds to the physical reference plane b-b shown in FIG. 1, where the shorted shunt stub 154 (FIGS. 24, 25) connects in parallel with output termination impedance quantity $Z_L/N$. 3) Between reference planes a-a and b-b (FIGS. 24, 25) is a unit element with characteristic impedance $Z_{SH}$, which is defined by the inner surface of ground conductor 105 and the outer surfaces 113*a* and 103*a* of conductors 113 and 103. The above described unit elements are substantially one-quarter wavelength long at the passband mid-band frequency $f_O$. One way of interpreting a quarter-wavelength transmission line (at the mid-band frequency $f_O$) is that it 'transforms' the wave admittance on a Smith Chart along a circle about the origin (where the reflection coefficient magnitude is zero) exactly 180 degrees.

In the illustrated embodiments, the quantity N of output RF connectors equals ten, and the corresponding quantity N of receiving bores 146 (FIG. 5 or 6, 18, 27 and 28) in the conductor 103 equals ten. Other values of N=2, 3, . . . , 12 or more are possible. For example, a two-way divider-combiner has quantity N=2 equally spaced receiving bores 146 (and therefore N=2 output RF connectors).

In the illustrated embodiments shown in FIG. 1, the overall structure may alternatively be constructed (excluding the input connector 119 and its center conductor bullet 117, and the ten output connectors 101 and their respective center conductors 102) using 3D printing using plastic or metal material, followed by plating with an electrically conducting material.

Divider output connectors 101 (FIGS. 1, 2, 3, 22, 23, 27, and 28) are shown as flange mounted Type N (female) connectors. Each output connector (only one of ten connectors 101 is shown in FIGS. 27 and 28) mounts to outer conductor 105 using two 4-40×3/16" cap screws SC6 (FIGS. 22, 23, 27, and 28). Other Type N (female, or male) mounting types and other fastener sizes and types, or mechanical attachments can be employed. Other kinds of output RF connectors, such as TNC, SMA, SC, 7-16 DIN, 4.3-10 DIN male or female, and other EIA-type flanges can be employed. Press-fit, brazed or soldered non-flanged RF connectors may also be employed.

In the illustrated embodiments, the center conductor 108 plus flange-cylinder 300 assembly is bolted to the end interior of ground conductor 105 by means of five 6-32×5/8" stainless steel O-ring-sealed cap screws SC5 (FIGS. 14, 15, 27, and 28). Other fastener sizes and types, or other mechanical attachment methods can be employed.

In various embodiments, the conductive cylinders 109, 106, 103, and 111 are connected thermally and electrically to respective 104 and 107 thermally and electrically conductive flanges. This provides a superior thermal, electrical, and easier-to-fabricate design.

In compliance with the patent statutes, the subject matter disclosed herein has been described in language more or less specific as to structural and methodical features. However, the scope of protection sought is to be limited only by the following claims, given their broadest possible interpretations. Such claims are not to be limited by the specific features shown and described above, as the description above only discloses example embodiments.

The invention claimed is:

1. A power combiner/divider having a front end and a rear end and comprising:

a main center conductor defining a central axis and being stepped, having first and second portions with different outer diameters;

an input connector having a center conductor, adapted to be coupled to a signal source, electrically coupled to the main conductor and having an axis aligned with the central axis;

a plurality of output connectors having respective axes that are perpendicular to the main conductor axis, the output connectors being radially spaced apart relative to the main conductor, the output connectors having center conductors;

a plurality of electrically conductive nested cylinders proximate the front end and arranged to define at least three gaps providing respective coaxial transmission lines; and a plurality of electrically conductive nested cylinders proximate the rear end, one of which having apertures perpendicular to the main conductor axis receiving the center conductors of the output connectors, the nested cylinders proximate the rear end defining at least three gaps.

2. A power combiner/divider in accordance with claim 1 wherein the gaps defined by the nested cylinders proximate the rear end define a unit element shorted shunt stub, and a nested pair of transmission lines, together defining a unit element coaxial transmission line.

3. A power combiner/divider in accordance with claim 1 and comprising a cylinder flange defining a first, front facing, one of the nested cylinders proximate the front end, having an inner cylindrical surface exterior of and spaced apart from the first portion of the main center conductor and having an outer cylindrical surface, and defining a first, rear facing, one of the nested cylinders proximate the rear end, having an inner cylindrical surface exterior of and spaced apart from the second portion of the main center conductor and having an outer cylindrical surface.

4. A power combiner/divider in accordance with claim 3 and comprising a main conductor-cylinder defining a second, rear facing one of the nested cylinders proximate the front end, and having an inner cylindrical surface exterior of and spaced apart from the outer surface of the first one of the nested cylinders proximate the front end and having an outer cylindrical surface.

5. A power combiner/divider in accordance with claim 4 wherein the input connector further includes an outer conductor, the power combiner/divider further comprising an exterior ground defining a third, rear facing one of the nested cylinders proximate the front end, electrically coupled to the outer conductor, and having an inner cylindrical surface exterior of and spaced apart from the outer surface of the second rear facing nested cylinders.

6. A power combiner/divider in accordance with claim 5 and comprising an outer backplate-cylinder flange assembly defining a second, front facing, one of the nested cylinders proximate the rear end, having an inner cylindrical surface exterior of and spaced apart from the outer cylindrical surface of the first one of the nested cylinders proximate the rear end and having an exterior cylindrical surface.

7. A power combiner/divider in accordance with claim 6 and comprising a hollow cylinder conductor defining a third one of the nested cylinders proximate the rear end, having an inner cylindrical surface exterior of and spaced apart from the outer cylindrical surface of the second one of the nested cylinders proximate the rear end and having apertures perpendicular to the central axis receiving an electrically coupled to the center conductors of the output connectors.

8. A power combiner/divider in accordance with claim 6 wherein the outer backplate-cylinder flange assembly is secured to the main conductor.

9. A power divider/combiner in accordance with claim 1 and further comprising means for selectively receiving and retaining a gas.

10. A power combiner/divider having a front end and a rear end and comprising:

a main center conductor defining a central axis and being stepped, having first, second, and third portions with different outer diameters;

an input connector having a center conductor, adapted to be coupled to a signal source, electrically coupled to the main conductor and having an axis aligned with the central axis;

a plurality of output connectors having respective axes that are perpendicular to the main conductor axis, the output connectors being radially spaced apart relative to the main conductor, the output connectors having center conductors;

a plurality of electrically conductive nested cylinders proximate the front end and arranged to define at least three gaps providing respective coaxial transmission lines; and a plurality of electrically conductive nested cylinders proximate the rear end, one of which being electrically coupled to the center conductors of the output connectors, the nested cylinders proximate the rear end defining a nested unit element coaxial transmission line and a unit element shorted shunt stub.

11. A power combiner/divider in accordance with claim 10 and comprising a cylinder flange defining a first, front facing, one of the nested cylinders proximate the front end, having an inner cylindrical surface exterior of and spaced apart from the first portion of the main center conductor and having an outer cylindrical surface, and defining a first, rear facing, one of the nested cylinders proximate the rear end, having an inner cylindrical surface exterior of and spaced apart from the second portion of the main center conductor and having an outer cylindrical surface.

12. A power combiner/divider in accordance with claim 11 and comprising a main conductor-cylinder defining a second, rear facing one of the nested cylinders proximate the front end, and having an inner cylindrical surface exterior of and spaced apart from the outer surface of the first one of the nested cylinders proximate the front end and having an outer cylindrical surface.

13. A power combiner/divider in accordance with claim 12 wherein the input connector further includes an outer conductor, the power combiner/divider further comprising an exterior ground defining a third, rear facing one of the nested cylinders proximate the front end, electrically coupled to the outer conductor, and having an inner cylindrical surface exterior of and spaced apart from the outer surface of the second rear facing nested cylinders.

14. A power combiner/divider in accordance with claim 13 and comprising an outer backplate-cylinder flange assembly defining a second, front facing, one of the nested cylinders proximate the rear end, having an inner cylindrical surface exterior of and spaced apart from the outer cylindrical surface of the first one of the nested cylinders proximate the rear end and having an exterior cylindrical surface.

15. A power combiner/divider in accordance with claim 14 and comprising a hollow cylinder conductor defining a third one of the nested cylinders proximate the rear end, having an inner cylindrical surface exterior of and spaced apart from the outer cylindrical surface of the second one of the nested cylinders proximate the rear end and having apertures perpendicular to the central axis receiving an electrically coupled to the center conductors of the output connectors.

16. A power combiner/divider in accordance with claim 15 wherein the outer backplate-cylinder flange assembly is secured to the main conductor.

17. A power divider/combiner in accordance with claim 10 and further comprising means for selectively receiving and retaining a gas.

18. A method in accordance with claim 15 and further comprising configuring the combiner-divider, using O-ring seals, to retain a gas introduced via the threaded bore.

19. A method of manufacturing a power combiner/divider, having a front end and a rear end, the method comprising:

providing a main center conductor defining a central axis and being stepped, having first, second, and third portions with different outer diameters;

providing an input connector having a center conductor, adapted to be coupled to a signal source and having an axis aligned with the central axis;

electrically coupling the input connector to the main conductor;

providing a plurality of output connectors having respective axes that are perpendicular to the main conductor axis, the output connectors being radially spaced apart relative to the main conductor, the output connectors having center conductors;

providing a plurality of electrically conductive nested cylinders proximate the front end;

arranging the nested cylinders to include three coaxial transmission lines;

providing a plurality of electrically conductive nested cylinders proximate the rear end;

electrically coupling one of the nested cylinders proximate the rear end to the center conductors of the output connectors; and defining a nested unit element coaxial transmission lines and a unit element shorted shunt stub using the conductive nested cylinders proximate the rear end.

20. A method in accordance with claim 19 wherein a fluid chamber is defined in the power combiner/divider, and the method further comprising providing a threaded bore in fluid communication with the passage, and providing a threaded plug, complementary to the threaded bore, plugging the threaded bore.

* * * * *